US007273688B2

(12) United States Patent
Suzuki et al.

(10) Patent No.: US 7,273,688 B2
(45) Date of Patent: Sep. 25, 2007

(54) IMAGE FORMING METHOD AND IMAGE FORMING APPARATUS FOR SAME

(75) Inventors: Koji Suzuki, Kanagawa (JP); Mitsuo Aoki, Shizuoka (JP); Bing Shu, Shizuoka (JP); Yasushi Koichi, Kanagawa (JP); Setsuo Soga, Tokyo (JP); Tadashi Kasai, Tokyo (JP); Yutaka Takahashi, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 11/503,152

(22) Filed: Aug. 14, 2006

(65) Prior Publication Data

US 2006/0275688 A1 Dec. 7, 2006

Related U.S. Application Data

(63) Continuation of application No. 10/806,104, filed on Mar. 23, 2004, now Pat. No. 7,125,638.

(30) Foreign Application Priority Data

Mar. 24, 2003 (JP) ..... 2003-081137
Mar. 24, 2003 (JP) ..... 2003-081151
Mar. 24, 2003 (JP) ..... 2003-081156

(51) Int. Cl.
*G03G 13/20* (2006.01)

(52) U.S. Cl. ..... 430/124; 430/120; 430/126; 430/110.3; 430/110.4; 430/111.4; 399/328; 399/46

(58) Field of Classification Search ..... 430/124, 430/120, 126, 110.3, 110.4, 111.4; 399/328, 399/46

See application file for complete search history.

(56) References Cited

U.S. PATENT DOCUMENTS

| | | | |
|---|---|---|---|
| 5,812,917 | A | 9/1998 | Iwata et al. |
| 5,873,017 | A | 2/1999 | Soga et al. |
| 5,912,100 | A | 6/1999 | Aoki et al. |
| 5,994,016 | A | 11/1999 | Kuramoto et al. |
| 6,060,201 | A | 5/2000 | Kinoshita et al. |
| 6,067,435 | A | 5/2000 | Soga et al. |
| 6,112,046 | A | 8/2000 | Suzuki et al. |
| 6,120,960 | A | 9/2000 | Aoki et al. |
| 6,248,488 | B1 | 6/2001 | Kinoshita et al. |
| 6,403,275 | B1 | 6/2002 | Kuramoto et al. |
| 6,496,666 | B2 | 12/2002 | Hayashi et al. |
| 6,593,048 | B2 | 7/2003 | Sasaki et al. |
| 6,667,141 | B2 | 12/2003 | Iwamoto et al. |
| 6,699,632 | B2 | 3/2004 | Higuchi et al. |

*Primary Examiner*—Mark A. Chapman
(74) *Attorney, Agent, or Firm*—Oblon, Spivak, McClelland, Maier & Neustadt, P.C.

(57) ABSTRACT

An electrophotographic image forming apparatus capable of reliably forming an image with density gradation, one which does not have a low-quality appearance. The estimated average halftone granularity of the toner image after developing but before electrostatic transfer was set at 0.25 or less. The average halftone granularity was found by measuring the granularity of a toner image at locations of different average brightness by means of newly proposed formula, and averaging the measured values for which the average brightness is 40 to 80. The estimated average halftone granularity was obtained by estimating the average halftone granularity of the toner image on a photoreceptor by means of a newly proposed method.

8 Claims, 35 Drawing Sheets

| GRADATION AREA RATIO | AVERAGE BRIGHTNESS L | GRANULARITY FROM FORMULA 3 |
|---|---|---|
| 3% | 92.6 | 0.08 |
| 6% | 88.8 | 0.21 |
| 9% | 85.4 | 0.30 |
| 12.5% | 82.0 | 0.30 |
| 16% | 78.2 | 0.35 |
| 20% | 74.1 | 0.43 |
| 25% | 69.1 | 0.44 |
| 30% | 65.1 | 0.47 |
| 41% | 51.9 | 0.50 |
| 50% | 45.7 | 0.41 |
| 59% | 36.9 | 0.38 |
| 70% | 31.4 | 0.34 |
| 80% | 23.7 | 0.24 |
| 91% | 17.6 | 0.20 |
| 100% | 14.1 | 0.13 |

FIG. 14

| TONER NO. | WEIGHT AVERAGE PARTICLE SIZE ( $\mu$ m) | AVERAGE CIRCULARITY | DEGREE OF DISPERSION |
|---|---|---|---|
| 1 | 4.2 | 0.98 | 1.1 |
| 2 | | | 1.2 |
| 3 | | | 1.3 |
| 4 | | | 1.4 |
| 5 | | 0.95 | 1.1 |
| 6 | | | 1.2 |
| 7 | | | 1.3 |
| 8 | | | 1.4 |
| 9 | | 0.90 | 1.1 |
| 10 | | | 1.2 |
| 11 | | | 1.3 |
| 12 | | | 1.4 |
| 13 | | 0.85 | 1.1 |
| 14 | | | 1.2 |
| 15 | | | 1.3 |
| 16 | | | 1.4 |

FIG. 15

| TONER NO. | WEIGHT AVERAGE PARTICLE SIZE (μm) | AVERAGE CIRCULARITY | DEGREE OF DISPERSION |
|---|---|---|---|
| 17 | 6.8 | 0.98 | 1.1 |
| 18 | | | 1.2 |
| 19 | | | 1.3 |
| 20 | | | 1.4 |
| 21 | | 0.95 | 1.1 |
| 22 | | | 1.2 |
| 23 | | | 1.3 |
| 24 | | | 1.4 |
| 25 | | 0.90 | 1.1 |
| 26 | | | 1.2 |
| 27 | | | 1.3 |
| 28 | | | 1.4 |
| 29 | | 0.85 | 1.1 |
| 30 | | | 1.2 |
| 31 | | | 1.3 |
| 32 | | | 1.4 |

FIG. 16

| TONER NO. | WEIGHT AVERAGE PARTICLE SIZE (μm) | AVERAGE CIRCULARITY | DEGREE OF DISPERSION |
|---|---|---|---|
| 33 | 9.0 | 0.98 | 1.1 |
| 34 | | | 1.2 |
| 35 | | | 1.3 |
| 36 | | | 1.4 |
| 37 | | 0.95 | 1.1 |
| 38 | | | 1.2 |
| 39 | | | 1.3 |
| 40 | | | 1.4 |
| 41 | | 0.90 | 1.1 |
| 42 | | | 1.2 |
| 43 | | | 1.3 |
| 44 | | | 1.4 |
| 45 | | 0.85 | 1.1 |
| 46 | | | 1.2 |
| 47 | | | 1.3 |
| 48 | | | 1.4 |

FIG. 17

| TONER NO. | WEIGHT AVERAGE PARTICLE SIZE (μm) | AVERAGE CIRCULARITY | DEGREE OF DISPERSION | ESTIMATED AVERAGE HALFTONE GRANULARITY OF PHOTO-RECEPTOR |
|---|---|---|---|---|
| 1 | 4.2 | 0.98 | 1.1 | 0.10 |
| 2 | | | 1.2 | 0.15 |
| 3 | | | 1.3 | 0.16 |
| 4 | | | 1.4 | 0.16 |
| 5 | | 0.95 | 1.1 | 0.10 |
| 6 | | | 1.2 | 0.12 |
| 7 | | | 1.3 | 0.17 |
| 8 | | | 1.4 | 0.18 |
| 9 | | 0.90 | 1.1 | 0.15 |
| 10 | | | 1.2 | 0.16 |
| 11 | | | 1.3 | 0.18 |
| 12 | | | 1.4 | 0.20 |
| 13 | | 0.85 | 1.1 | 0.18 |
| 14 | | | 1.2 | 0.18 |
| 15 | | | 1.3 | 0.17 |
| 16 | | | 1.4 | 0.21 |

FIG. 18

| TONER NO. | WEIGHT AVERAGE PARTICLE SIZE (μm) | AVERAGE CIRCULARITY | DEGREE OF DISPERSION | ESTIMATED AVERAGE HALFTONE GRANULARITY OF PHOTO-RECEPTOR |
|---|---|---|---|---|
| 17 | 6.8 | 0.98 | 1.1 | 0.16 |
| 18 | | | 1.2 | 0.19 |
| 19 | | | 1.3 | 0.23 |
| 20 | | | 1.4 | 0.22 |
| 21 | | 0.95 | 1.1 | 0.16 |
| 22 | | | 1.2 | 0.19 |
| 23 | | | 1.3 | 0.21 |
| 24 | | | 1.4 | 0.23 |
| 25 | | 0.90 | 1.1 | 0.19 |
| 26 | | | 1.2 | 0.21 |
| 27 | | | 1.3 | 0.23 |
| 28 | | | 1.4 | 0.24 |
| 29 | | 0.85 | 1.1 | 0.20 |
| 30 | | | 1.2 | 0.22 |
| 31 | | | 1.3 | 0.22 |
| 32 | | | 1.4 | 0.24 |

FIG. 19

| TONER NO. | WEIGHT AVERAGE PARTICLE SIZE (μm) | AVERAGE CIRCULARITY | DEGREE OF DISPERSION | ESTIMATED AVERAGE HALFTONE GRANULARITY OF PHOTO-RECEPTOR |
|---|---|---|---|---|
| 33 | 9.0 | 0.98 | 1.1 | 0.24 |
| 34 | | | 1.2 | 0.24 |
| 35 | | | 1.3 | 0.25 |
| 36 | | | 1.4 | 0.29 |
| 37 | | 0.95 | 1.1 | 0.25 |
| 38 | | | 1.2 | 0.25 |
| 39 | | | 1.3 | 0.28 |
| 40 | | | 1.4 | 0.30 |
| 41 | | 0.90 | 1.1 | 0.24 |
| 42 | | | 1.2 | 0.27 |
| 43 | | | 1.3 | 0.26 |
| 44 | | | 1.4 | 0.25 |
| 45 | | 0.85 | 1.1 | 0.27 |
| 46 | | | 1.2 | 0.31 |
| 47 | | | 1.3 | 0.38 |
| 48 | | | 1.4 | 0.36 |

FIG. 20A

FIG. 20

| FIG. 20A | FIG. 20B | FIG. 20C |
|---|---|---|

| TONER NO. | WEIGHT AVERAGE PARTICLE SIZE (μm) | AVERAGE CIRCU-LARITY | DEGREE OF DISPERSION | GRANULARITY ON PHOTO-RECEPTOR (A) | TRANSFER PRESSURE (N/mm²) | TRANSFER CURRENT (nA/mm²) | UNFIXED GRANU-LARITY (B) | INCREASE IN GRANULARITY DUE TO TRANSFER (B-A) |
|---|---|---|---|---|---|---|---|---|
| 1 | 4.2 | 0.98 | 1.1 | 0.10 | 0.04 | 10 | 0.25 | 0.15 |
| | | | | | | 20 | 0.20 | 0.10 |
| | | | | | | 200 | 0.17 | 0.07 |
| | | | | | | 400 | 0.17 | 0.07 |
| | | | | | 0.20 | 10 | 0.23 | 0.13 |
| | | | | | | 20 | 0.17 | 0.07 |
| | | | | | | 200 | 0.15 | 0.04 |
| | | | | | | 400 | 0.16 | 0.06 |
| | | | | | 1.00 | 10 | 0.22 | 0.12 |
| | | | | | | 20 | 0.16 | 0.06 |
| | | | | | | 200 | 0.14 | 0.04 |
| | | | | | | 400 | 0.15 | 0.05 |
| | | | | | 2.00 | 10 | 0.22 | 0.12 |
| | | | | | | 20 | 0.22 | 0.12 |
| | | | | | | 200 | 0.22 | 0.12 |
| | | | | | | 400 | 0.25 | 0.15 |

FIG. 20B

| | | | | | | | | | | | | | | | | | | | | | | | |
|---|---|---|---|---|---|---|---|---|---|---|---|---|---|---|---|---|---|---|---|---|---|---|---|
| 7 | 4.2 | 0.95 | 1.3 | 0.17 | 0.04 | 10 | 0.31 | 0.14 | 0.20 | 20 | 0.28 | 0.11 | 0.20 | 200 | 0.25 | 0.08 | 0.20 | 400 | 0.25 | 0.08 | 0.20 | 10 | 0.30 | 0.13 |
| | | | | | | 20 | 0.23 | 0.06 | | 200 | 0.22 | 0.05 | | 400 | 0.24 | 0.07 | 1.00 | 10 | 0.28 | 0.11 | | 20 | 0.24 | 0.07 |
| | | | | | | 200 | 0.22 | 0.05 | | 400 | 0.24 | 0.07 | | 10 | 0.28 | 0.11 | | 20 | 0.24 | 0.07 | | 200 | 0.22 | 0.05 |
| | | | | | | 400 | 0.22 | 0.05 | | 10 | 0.29 | 0.12 | 2.00 | 20 | 0.31 | 0.14 | | 200 | 0.29 | 0.12 | | 400 | 0.22 | 0.05 |
| | | | | | | 10 | 0.29 | 0.12 | | 20 | 0.31 | 0.14 | | 200 | 0.29 | 0.12 | | 400 | 0.31 | 0.14 | | | | |

FIG. 20C

| | | | | | | | |
|---|---|---|---|---|---|---|---|
| 16 | 4.2 | 0.85 | 1.4 | 0.21 | 0.04 | 10 | 0.35 | 0.14 |
| | | | | | | 20 | 0.31 | 0.10 |
| | | | | | | 200 | 0.28 | 0.08 |
| | | | | | | 400 | 0.29 | 0.08 |
| | | | | | 0.20 | 10 | 0.35 | 0.14 |
| | | | | | | 20 | 0.29 | 0.08 |
| | | | | | | 200 | 0.27 | 0.06 |
| | | | | | | 400 | 0.26 | 0.05 |
| | | | | | 1.00 | 10 | 0.34 | 0.13 |
| | | | | | | 20 | 0.27 | 0.06 |
| | | | | | | 200 | 0.26 | 0.05 |
| | | | | | | 400 | 0.26 | 0.05 |
| | | | | | 2.00 | 10 | 0.35 | 0.14 |
| | | | | | | 20 | 0.33 | 0.12 |
| | | | | | | 200 | 0.37 | 0.16 |
| | | | | | | 400 | 0.36 | 0.15 |

FIG. 21A

FIG. 21

| FIG. 21A | FIG. 21B | FIG. 21C |
|---|---|---|

| TONER NO. | WEIGHT AVERAGE PARTICLE SIZE (μm) | AVERAGE CIRCU-LARITY | DEGREE OF DISPERSION | GRANULARITY ON PHOTO-RECEPTOR (A) | TRANSFER PRESSURE (N/mm²) | TRANSFER CURRENT (nA/mm²) | UNFIXED GRANU-LARITY (B) | INCREASE IN GRANULARITY DUE TO TRANSFER (B-A) |
|---|---|---|---|---|---|---|---|---|
| 17 | 6.8 | 0.98 | 1.1 | 0.16 | 0.04 | 10 | 0.32 | 0.16 |
| | | | | | | 20 | 0.29 | 0.13 |
| | | | | | | 200 | 0.23 | 0.07 |
| | | | | | | 400 | 0.24 | 0.08 |
| | | | | | 0.20 | 10 | 0.29 | 0.13 |
| | | | | | | 20 | 0.23 | 0.07 |
| | | | | | | 200 | 0.22 | 0.06 |
| | | | | | | 400 | 0.23 | 0.07 |
| | | | | | 1.00 | 10 | 0.28 | 0.12 |
| | | | | | | 20 | 0.21 | 0.05 |
| | | | | | | 200 | 0.23 | 0.06 |
| | | | | | | 400 | 0.21 | 0.05 |
| | | | | | 2.00 | 10 | 0.30 | 0.14 |
| | | | | | | 20 | 0.28 | 0.12 |
| | | | | | | 200 | 0.29 | 0.13 |
| | | | | | | 400 | 0.31 | 0.15 |

FIG. 21B

| | | | | | | | | | | | | | | | | | | | | | | | |
|---|---|---|---|---|---|---|---|---|---|---|---|---|---|---|---|---|---|---|---|---|---|---|---|
| 25 | 6.8 | 0.90 | 1.1 | 0.19 | 0.04 | 10 | 0.31 | 0.12 | 0.20 | 20 | 0.30 | 0.11 | 0.20 | 200 | 0.26 | 0.07 | 0.20 | 400 | 0.27 | 0.08 | 0.20 | 10 | 0.34 | 0.15 |
| | | | | | | 20 | 0.27 | 0.08 | | 200 | 0.24 | 0.05 | | 400 | 0.26 | 0.07 | 1.00 | 10 | 0.31 | 0.12 | 1.00 | 20 | 0.26 | 0.07 |
| | | | | | | 200 | 0.24 | 0.05 | | 400 | 0.26 | 0.07 | 1.00 | 10 | 0.29 | 0.13 | 1.00 | 20 | 0.33 | 0.14 | 1.00 | 200 | 0.33 | 0.14 |
| | | | | | | 400 | 0.26 | 0.07 | 2.00 | 10 | 0.29 | 0.13 | 2.00 | 20 | 0.33 | 0.14 | 2.00 | 200 | 0.32 | 0.13 | 2.00 | 400 | 0.32 | 0.13 |

FIG. 21C

| | | | | | | | |
|---|---|---|---|---|---|---|---|
| 32 | 6.8 | 0.85 | 1.4 | 0.24 | 0.04 | 10 | 0.32 | 0.13 |
| | | | | | | 20 | 0.29 | 0.10 |
| | | | | | | 200 | 0.27 | 0.08 |
| | | | | | | 400 | 0.25 | 0.06 |
| | | | | | 0.20 | 10 | 0.33 | 0.14 |
| | | | | | | 20 | 0.27 | 0.08 |
| | | | | | | 200 | 0.25 | 0.06 |
| | | | | | | 400 | 0.26 | 0.07 |
| | | | | | 1.00 | 10 | 0.32 | 0.13 |
| | | | | | | 20 | 0.25 | 0.06 |
| | | | | | | 200 | 0.24 | 0.05 |
| | | | | | | 400 | 0.26 | 0.07 |
| | | | | | 2.00 | 10 | 0.33 | 0.14 |
| | | | | | | 20 | 0.31 | 0.12 |
| | | | | | | 200 | 0.32 | 0.13 |
| | | | | | | 400 | 0.33 | 0.14 |

FIG. 25A

FIG. 25 | FIG. 25A | FIG. 25B

| TONER NO. | WEIGHT AVERAGE PARTICLE SIZE ($\mu$m) | AVERAGE CIRCULARITY | DEGREE OF DISPERSION | GRANULARITY ON PHOTORECEPTOR (A) | TRANSFER PRESSURE (N/mm$^2$) |
|---|---|---|---|---|---|
| 1 | 4.2 | 0.98 | 1.1 | 0.10 | 0.2 |
| | | | | | 1.0 |
| 7 | 4.2 | 0.95 | 1.3 | 0.17 | 0.2 |
| | | | | | 1.0 |

FIG. 25B

| TRANSFER CURRENT ($nA/mm^2$) | UNFIXED GRANULARITY (B) | TYPE OF FIXING ROLLER | GRANULARITY AFTER FIXING (C) | INCREASE IN GRANULARITY DUE TO FIXING (C−B) |
|---|---|---|---|---|
| 20 | 0.17 | ① | 0.21 | 0.04 |
| | | ② | 0.27 | 0.10 |
| | | ③ | 0.33 | 0.16 |
| 200 | 0.15 | ① | 0.19 | 0.04 |
| | | ② | 0.27 | 0.12 |
| | | ③ | 0.30 | 0.15 |
| 20 | 0.16 | ① | 0.21 | 0.05 |
| | | ② | 0.27 | 0.11 |
| | | ③ | 0.31 | 0.15 |
| 200 | 0.14 | ① | 0.18 | 0.04 |
| | | ② | 0.24 | 0.10 |
| | | ③ | 0.31 | 0.17 |
| 20 | 0.17 | ① | 0.28 | 0.05 |
| | | ② | 0.34 | 0.11 |
| | | ③ | 0.40 | 0.17 |
| 200 | 0.15 | ① | 0.28 | 0.06 |
| | | ② | 0.34 | 0.12 |
| | | ③ | 0.38 | 0.16 |
| 20 | 0.16 | ① | 0.28 | 0.04 |
| | | ② | 0.34 | 0.10 |
| | | ③ | 0.40 | 0.16 |
| 200 | 0.14 | ① | 0.28 | 0.06 |
| | | ② | 0.31 | 0.09 |
| | | ③ | 0.38 | 0.16 |

| TONER LETTER | SPACE FACTOR SF-1 | AVERAGE CIRCULARITY | DEGREE OF DISPERSION | DEGREE OF DISPERSION | GRANULARITY ON PHOTORECEPTOR (A) |
|---|---|---|---|---|---|
| A | 140 | 0.92 | 1.39 | 25 | 0.18 |

FIG. 31A

FIG. 31

| FIG. 31A |
|---|
| FIG. 31B |

| TONER LETTER | SHAPE FACTOR SF-1 | AVERAGE CIRCU-LARITY | DEGREE OF DIS-PERSION | DEGREE OF DIS-PERSION | GRANULARITY ON PHOTO-RECEPTOR (A) | TRANSFER PRESSURE ($N/mm^2$) | TRANSFER CURRENT ($nA/mm^2$) |
|---|---|---|---|---|---|---|---|
| B | 130 | 0.92 | 1.37 | 24 | 0.17 | 0.04 | 10 |
| | | | | | | | 20 |
| | | | | | | | 200 |
| | | | | | | | 400 |
| | | | | | | 0.20 | 10 |
| | | | | | | | 20 |
| | | | | | | | 200 |
| | | | | | | | 400 |
| | | | | | | 1.00 | 10 |
| | | | | | | | 20 |
| | | | | | | | 200 |
| | | | | | | | 400 |
| | | | | | | 2.00 | 10 |
| | | | | | | | 20 |
| | | | | | | | 200 |
| | | | | | | | 400 |

FIG. 31B

| TRANSFER RATIO (%) | UNFIXED GRANU-LARITY (B) | INCREASE IN GRANULARITY DUE TO TRANSFER (B-A) | TYPE OF FIXING ROLLER | GRANULARITY AFTER FIXING (C) | INCREASE IN GRANULARITY DUE TO FIXING (C-B) |
|---|---|---|---|---|---|
| 31 (×) | | | | | |
| 81 (○) | 0.32 | 0.15 | | | |
| 84 (○) | 0.27 | 0.10 | | | |
| 82 (○) | 0.26 | 0.09 | | | |
| 32 (×) | | | | | |
| 84 (○) | 0.24 | 0.07 | ① | 0.28 | 0.04 |
| | | | ② | 0.34 | 0.10 |
| | | | ③ | 0.40 | 0.16 |
| 87 (○) | 0.23 | 0.06 | ① | 0.29 | 0.05 |
| | | | ② | 0.34 | 0.10 |
| | | | ③ | 0.38 | 0.15 |
| 85 (○) | 0.25 | 0.08 | | | |
| 47 (×) | | 0.06 | | | |
| 86 (○) | 0.23 | 0.06 | ① | 0.27 | 0.04 |
| | | | ② | 0.34 | 0.11 |
| | | | ③ | 0.38 | 0.15 |
| 86 (○) | 0.22 | 0.05 | ① | 0.27 | 0.05 |
| | | | ② | 0.34 | 0.12 |
| | | | ③ | 0.42 | 0.20 |
| 85 (○) | 0.25 | 0.08 | | | |
| 57 (×) | | | | | |
| 82 (○) | 0.31 | 0.14 | | | |
| 81 (○) | 0.29 | 0.12 | | | |
| 73 (△) | | | | | |

FIG. 32A

FIG. 32

| FIG. 32A |
|---|
| FIG. 32B |

| TONER LETTER | SHAPE FACTOR SF-1 | AVERAGE CIRCU-LARITY | DEGREE OF DIS-PERSION | DEGREE OF DIS-PERSION | GRANULARITY ON PHOTO-RECEPTOR (A) | TRANSFER PRESSURE ($N/mm^2$) | TRANSFER CURRENT ($nA/mm^2$) |
|---|---|---|---|---|---|---|---|
| C | 125 | 0.96 | 1.35 | 22 | 0.15 | 0.04 | 10 |
| | | | | | | | 20 |
| | | | | | | | 200 |
| | | | | | | | 400 |
| | | | | | | 0.20 | 10 |
| | | | | | | | 20 |
| | | | | | | | 200 |
| | | | | | | | 400 |
| | | | | | | 1.00 | 10 |
| | | | | | | | 20 |
| | | | | | | | 200 |
| | | | | | | | 400 |
| | | | | | | 2.00 | 10 |
| | | | | | | | 20 |
| | | | | | | | 200 |
| | | | | | | | 400 |

FIG. 32B

| TRANSFER RATIO (%) | UNFIXED GRANU-LARITY (B) | INCREASE IN GRANULARITY DUE TO TRANSFER (B-A) | TYPE OF FIXING ROLLER | GRANULARITY AFTER FIXING (C) | INCREASE IN GRANULARITY DUE TO FIXING (C-B) |
|---|---|---|---|---|---|
| 30 (×) | | | | | |
| 80 (○) | 0.32 | 0.12 | | | |
| 85 (○) | 0.22 | 0.07 | | | |
| 80 (○) | 0.22 | 0.07 | | | |
| 30 (×) | | | | | |
| 83 (○) | 0.20 | 0.05 | ① | 0.24 | 0.04 |
| | | | ② | 0.30 | 0.10 |
| | | | ③ | 0.36 | 0.16 |
| 88 (○) | 0.19 | 0.04 | ① | 0.24 | 0.05 |
| | | | ② | 0.31 | 0.12 |
| | | | ③ | 0.37 | 0.18 |
| 85 (○) | 0.21 | 0.06 | | | |
| 45 (×) | 0.21 | | | | |
| 86 (○) | 0.21 | 0.06 | ① | 0.25 | 0.04 |
| | | | ② | 0.31 | 0.10 |
| | | | ③ | 0.39 | 0.18 |
| 86 (○) | 0.19 | 0.04 | ① | 0.23 | 0.04 |
| | | | ② | 0.29 | 0.10 |
| | | | ③ | 0.35 | 0.16 |
| 85 (○) | 0.22 | 0.07 | | | |
| 57 (×) | | | | | |
| 80 (○) | 0.28 | 0.13 | | | |
| 81 (○) | 0.27 | 0.12 | | | |
| 75 (△) | | | | | |

FIG. 33A

FIG. 33

| FIG. 33A |
|---|
| FIG. 33B |

| TONER LETTER | SHAPE FACTOR SF-1 | AVERAGE CIRCU-LARITY | DEGREE OF DIS-PERSION | DEGREE OF DIS-PERSION | GRANULARITY ON PHOTO-RECEPTOR (A) | TRANSFER PRESSURE ($N/mm^2$) | TRANSFER CURRENT ($nA/mm^2$) |
|---|---|---|---|---|---|---|---|
| D | 120 | 0.97 | 1.21 | 22 | 0.13 | 0.04 | 10 |
| | | | | | | | 20 |
| | | | | | | | 200 |
| | | | | | | | 400 |
| | | | | | | 0.20 | 10 |
| | | | | | | | 20 |
| | | | | | | | 200 |
| | | | | | | | 400 |
| | | | | | | 1.00 | 10 |
| | | | | | | | 20 |
| | | | | | | | 200 |
| | | | | | | | 400 |
| | | | | | | 2.00 | 10 |
| | | | | | | | 20 |
| | | | | | | | 200 |
| | | | | | | | 400 |

FIG. 33B

| TRANSFER RATIO (%) | UNFIXED GRANU-LARITY (B) | INCREASE IN GRANULARITY DUE TO TRANSFER (B-A) | TYPE OF FIXING ROLLER | GRANULARITY AFTER FIXING (C) | INCREASE IN GRANULARITY DUE TO FIXING (C-B) |
|---|---|---|---|---|---|
| 32 (×) | | | | | |
| 80 (○) | 0.23 | 0.10 | | | |
| 85 (○) | 0.21 | 0.08 | | | |
| 83 (○) | 0.20 | 0.07 | | | |
| 33 (×) | | | | | |
| 85 (○) | 0.20 | 0.07 | ① | 0.23 | 0.03 |
| | | | ② | 0.30 | 0.10 |
| | | | ③ | 0.36 | 0.16 |
| 86 (○) | 0.17 | 0.04 | ① | 0.21 | 0.04 |
| | | | ② | 0.26 | 0.09 |
| | | | ③ | 0.33 | 0.16 |
| 85 (○) | | 0.07 | | | |
| 47 (×) | | | | | |
| 85 (○) | 0.19 | 0.06 | ① | 0.23 | 0.04 |
| | | | ② | 0.29 | 0.10 |
| | | | ③ | 0.36 | 0.17 |
| 86 (○) | 0.17 | 0.04 | ① | 0.20 | 0.03 |
| | | | ② | 0.28 | 0.11 |
| | | | ③ | 0.33 | 0.16 |
| 85 (○) | 0.20 | 0.07 | | | |
| 56 (×) | | | | | |
| 80 (○) | 0.25 | 0.12 | | | |
| 82 (○) | 0.25 | 0.12 | | | |
| 75 (△) | | | | | |

FIG. 34A

FIG. 34

FIG. 34A

FIG. 34B

| TONER LETTER | SHAPE FACTOR SF-1 | AVERAGE CIRCU-LARITY | DEGREE OF DIS-PERSION | DEGREE OF DIS-PERSION | GRANULARITY ON PHOTO-RECEPTOR (A) | TRANSFER PRESSURE ($N/mm^2$) | TRANSFER CURRENT ($nA/mm^2$) |
|---|---|---|---|---|---|---|---|
| E | 115 | 0.97 | 1.20 | 18 | 0.10 | 0.04 | 10 |
| | | | | | | | 20 |
| | | | | | | | 200 |
| | | | | | | | 400 |
| | | | | | | 0.20 | 10 |
| | | | | | | | 20 |
| | | | | | | | 200 |
| | | | | | | | 400 |
| | | | | | | 1.00 | 10 |
| | | | | | | | 20 |
| | | | | | | | 200 |
| | | | | | | | 400 |
| | | | | | | 2.00 | 10 |
| | | | | | | | 20 |
| | | | | | | | 200 |
| | | | | | | | 400 |

FIG. 34B

| TRANSFER RATIO (%) | UNFIXED GRANU-LARITY (B) | INCREASE IN GRANULARITY DUE TO TRANSFER (B-A) | TYPE OF FIXING ROLLER | GRANULARITY AFTER FIXING (C) | INCREASE IN GRANULARITY DUE TO FIXING (C-B) |
|---|---|---|---|---|---|
| 33 (×) | | | | | |
| 81 (○) | 0.20 | 0.10 | | | |
| 83 (○) | 0.18 | 0.08 | | | |
| 81 (○) | 0.17 | 0.07 | | | |
| 30 (×) | | | | | |
| 83 (○) | 0.16 | 0.06 | ① | 0.20 | 0.03 |
| | | | ② | 0.26 | 0.10 |
| | | | ③ | 0.32 | 0.16 |
| 85 (○) | 0.14 | 0.04 | ① | 0.17 | 0.04 |
| | | | ② | 0.25 | 0.09 |
| | | | ③ | 0.30 | 0.16 |
| 85 (○) | 0.16 | 0.06 | | | |
| 45 (×) | | | | | |
| 84 (○) | 0.16 | 0.06 | ① | 0.19 | 0.04 |
| | | | ② | 0.22 | 0.10 |
| | | | ③ | 0.34 | 0.17 |
| 85 (○) | 0.14 | 0.04 | ① | 0.18 | 0.03 |
| | | | ② | 0.24 | 0.11 |
| | | | ③ | 0.32 | 0.16 |
| 85 (○) | 0.15 | 0.05 | | | |
| 85 (×) | | | | | |
| 80 (○) | 0.24 | 0.14 | | | |
| 81 (○) | 0.22 | 0.12 | | | |
| 78 (△) | | | | | |

FIG. 35A

FIG. 35

| FIG. 35A |
|---|
| FIG. 35B |

| TONER LETTER | SHAPE FACTOR SF-1 | AVERAGE CIRCU-LARITY | DEGREE OF DIS-PERSION | DEGREE OF DIS-PERSION | GRANULARITY ON PHOTO-RECEPTOR (A) | TRANSFER PRESSURE ($N/mm^2$) | TRANSFER CURRENT ($nA/mm^2$) |
|---|---|---|---|---|---|---|---|
| F | 115 | 0.97 | 1.20 | 7 | 0.08 | 0.04 | 10 |
| | | | | | | | 20 |
| | | | | | | | 200 |
| | | | | | | | 400 |
| | | | | | | 0.20 | 10 |
| | | | | | | | 20 |
| | | | | | | | 200 |
| | | | | | | | 400 |
| | | | | | | 1.00 | 10 |
| | | | | | | | 20 |
| | | | | | | | 200 |
| | | | | | | | 400 |
| | | | | | | 2.00 | 10 |
| | | | | | | | 20 |
| | | | | | | | 200 |
| | | | | | | | 400 |

FIG. 35B

| TRANSFER RATIO (%) | UNFIXED GRANU-LARITY (B) | INCREASE IN GRANULARITY DUE TO TRANSFER (B-A) | TYPE OF FIXING ROLLER | GRANULARITY AFTER FIXING (C) | INCREASE IN GRANULARITY DUE TO FIXING (C-B) |
|---|---|---|---|---|---|
| 30 (×) | | | | | |
| 80 (○) | 0.18 | 0.10 | | | |
| 83 (○) | 0.17 | 0.09 | | | |
| 81 (○) | 0.15 | 0.07 | | | |
| 31 (×) | 0.21 | 0.13 | | | |
| 85 (○) | 0.13 | 0.05 | ① | 0.17 | 0.04 |
| | | | ② | 0.23 | 0.10 |
| | | | ③ | 0.29 | 0.16 |
| 86 (○) | 0.12 | 0.04 | ① | 0.16 | 0.04 |
| | | | ② | 0.23 | 0.11 |
| | | | ③ | 0.29 | 0.17 |
| 85 (○) | 0.14 | 0.06 | | | |
| 47 (×) | | | | | |
| 86 (○) | 0.14 | 0.06 | ① | 0.18 | 0.04 |
| | | | ② | 0.24 | 0.10 |
| | | | ③ | 0.31 | 0.17 |
| 88 (○) | 0.12 | 0.04 | ① | 0.16 | 0.04 |
| | | | ② | 0.21 | 0.09 |
| | | | ③ | 0.28 | 0.16 |
| 85 (○) | 0.13 | 0.05 | | | |
| 58 (×) | | | | | |
| 80 (○) | 0.20 | 0.12 | | | |
| 80 (○) | 0.22 | 0.14 | | | |
| 75 (△) | | | | | |

IMAGE FORMING METHOD AND IMAGE FORMING APPARATUS FOR SAME

This application is a Continuation of application Ser. No. 10/806,104 filed Mar. 23, 2004, now U.S. Pat. No. 7,125,638 the entire contents of which are incorporated herein by reference, and claims the benefit of priority from the prior Japanese Patent Application Nos. 2003-081137 filed Mar. 24, 2003; 2003-081151 filed Mar. 24, 2003; and 2003-081156 filed Mar. 24, 2003.

BACKGROUND OF THE INVENTION

1. Field of the Invention

The present invention relates to an image forming method for forming an image by electrophotography, and to a copier, facsimile device, printer, or other such image forming apparatus that makes use of this method.

2. Description of the Related Art

Conventional image forming methods for forming an image by electrophotography have been disclosed, for example, in Japanese Laid-Open Patent Applications 2002-202638 and 2002-287545. With these image forming methods, first a latent image is formed by an exposure apparatus on a latent image support such as a photoreceptor, after which this latent image is developed and made visible by causing toner to adhere electrostatically thereto. Next, this developed toner image is electrostatically transferred onto transfer paper or another such recording medium, then a fixing roller or other such heating member is brought into close contact to heat this toner and fix it to the recording medium.

One advantage to an electrophotographic image forming method such as this is that an image can be easily formed on the basis of electronic image information, but a disadvantage is that image quality is inevitably inferior to that produced by offset printing. In particular, with images having density gradation, such as photographs or pictures, the roughness is much more pronounced than with offset printing, and tends to give the viewer an impression of lower quality. Consequently, an important question with electrophotography is how to minimize this appearance of lower quality.

RMS granularity, which has been standardized in ANSI PH-2.40-1985 is known as an index of the roughness of an image, and this is calculated from the following Eq. 1.

$$RMS \text{ granularity } \sigma D=[(1/N)\times\Sigma(Di-D)^2]^{1/2} \quad \text{Eq. (1)}$$

Here, N is the number of data, Di is the density distribution, and D is the average density ($D=1/N\Sigma Di$).

Also, granularity GS defined by Dooley and Shaw of Xerox is another known index of roughness. This is the numerical value obtained by integrating the cascade values of a visual spatial-frequency characteristic (visual transfer function (VTF)) and the Wiener Spectrum (hereinafter referred to as WS(f)). WS(f) is the squared ensemble average of a Fourier spectrum obtained by the Fourier transformation of a density fluctuation from an average density obtained by scanning an image with a microdensitometer. The granularity GS is calculated from the following Eq. 2 (for details, see Dooley and Shaw: "Noise perception in Electrophotography," J. Appl. Photogr. Eng., Vol. 5, No. 4, (1979), pp. 190-196).

$$\text{granularity } GS=\exp(-1.8D)\int(WS(f))^{1/2}VTF(f)df \quad \text{Eq. 2}$$

Here, D is the average density, f is the spatial frequency (c/mm), and VTF(f) is the visual spatial-frequency characteristic.

However, of the images printed out by a given image forming apparatus, some have relatively good RMS granularity σD and granularity GS, while others do not. It is therefore difficult to evaluate the performance of an image forming apparatus on the basis of the RMS granularity σD and granularity GS of a printed image. Furthermore, up to now there had yet to be adequate study into what kind of images do not have a grainy look. Plus, none of the electrophotographic image forming apparatuses on the market today allow for the reliable formation of images that do not have a low-quality appearance.

SUMMARY OF THE INVENTION

The present invention provides an electrophotographic image forming method with which images of density gradation and that do not have a low-quality appearance can be reliably formed, and an image forming apparatus for the same.

BRIEF DESCRIPTION OF THE DRAWINGS

The above and other objects, features and advantages of the present invention will become more apparent from the following detailed description taken with the accompanying drawings in which:

FIGS. 14 to 16 are tables showing the relation between the weight average particle size, average circularity, and degree of dispersion pertaining to a total of 48 types of toner in the first example of the present invention;

FIGS. 17 to 19 are tables of the estimated average halftone granularity on the photoreceptor pertaining to these 48 types of toner;

FIGS. 20 and 21 are tables of the properties of toners whose weight average particle size is 4.2 u and 6.8 μm, and the average halftone granularity and transfer ratio in a grayscale image on unfixed transfer paper obtained using each toner;

FIG. 25 is a table showing the relation between the toner properties, the transfer conditions, the fixing conditions, and the average halftone granularity (or estimated value thereof) at each step of the grayscale images;

FIG. 29 is a schematic diagram illustrating the method for computing the shape factor SF-1; and FIGS. 30 to 35 are tables showing the relation between the properties of toners A to F in a second example of the present invention and the estimated average halftone granularity of the grayscale image after developing (before transfer).

DESCRIPTION OF THE PREFERRED EMBODIMENTS

The present invention will be described in detail below with reference to the drawings.

The inventors arrived at the present invention by conducting diligent research as described below.

Figure 2:
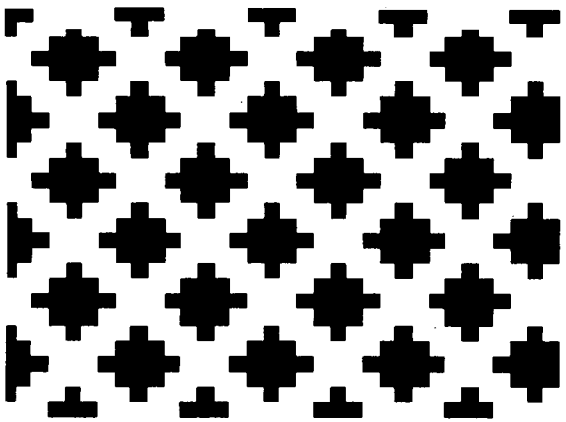
FIG. 2 is a detail view of a location close to the center of the gradation area ratio in this image.
Figure 3:
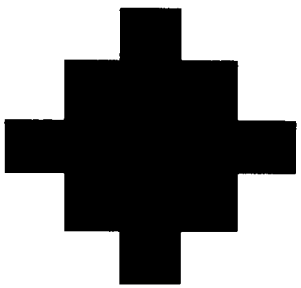
FIG. 3 is a detail view of a scale image at a location close to the center of this gradation area ratio.

First, electronic data were readied for grayscale with 15 different gradation area ratios, which had undergone dither processing on 106 screen lines at 600 dpi. These 15 gradation area ratios consisting of area ratios of 3, 6, 9, 12.5, 16, 20, 25, 30, 41, 50, 59, 70, 80, 91, and 100%. FIG. 2 is a detail view of a location close to the center of the gradation area ratio (area ratio=41%) in a grayscale image of a personal computer display based on electronic data. FIG. 3 is a detail view of a scale image at a location close to the center of this gradation area ratio.

Next, the inventors used a No. 1 test machine (an electrophotographic printer) to print out the above-mentioned grayscale image based on electronic data, and measured the average brightness L and the RMS granularity σD for each area ratio. They also used a No. 2 test machine (an electrophotographic printer) to print out a grayscale image in similar fashion, and measured the average brightness L and the RMS granularity σD for each area ratio (gradation on the display). The resolution of this No. 2 test machine was the same (600 dpi) as that of the No. 1 test machine, but a preliminary examination revealed that the roughness of the printed image was greater than that with the No. 1 test machine. The average brightness L is the average of the various readings L*.

Figures 4, 5:
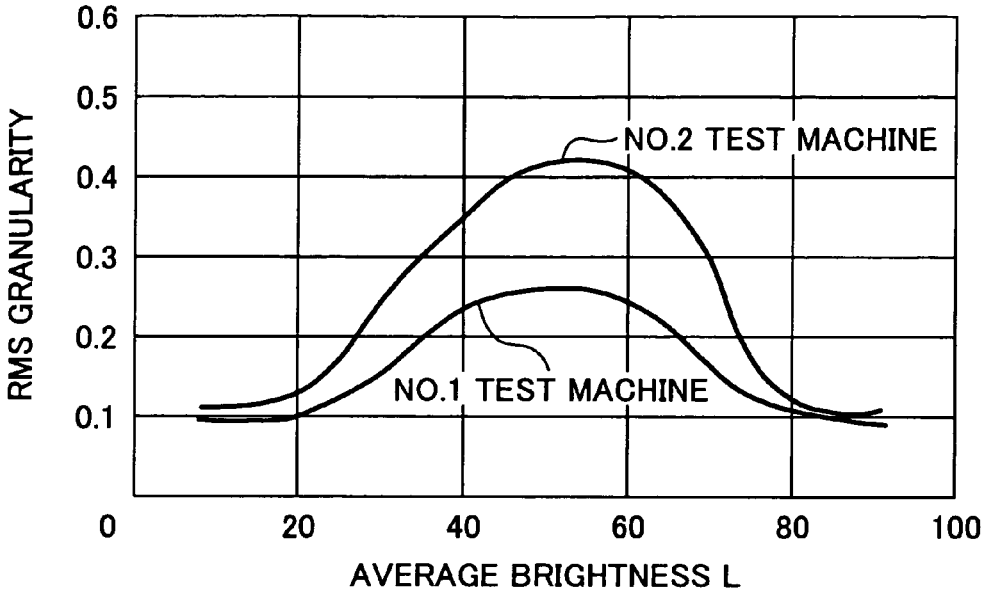
FIG. 4 is a graph of the relation between the average brightness L and the RMS granularity σD at various gradations of a grayscale image.
FIG. 5 is a table showing the relation between the area ratio of the image portion, the average brightness, and the granularity obtained from Eq. 3.

FIG. 4 is a graph of the relation between the average brightness L and the RMS granularity σD at various gradations of a grayscale image printed out by the above-mentioned No. 1 and No. 2 test machines. As seen in the graph, there is no pronounced difference in the RMS granularity σD of two grayscale images where the average brightness L is less than 20. It can also be seen that there is no pronounced difference in the RMS granularity σD of two grayscale images where the average brightness L is over 80. The reasons for this are described below.

With a digitally printed image in which density gradation is expressed by a difference in the density of a repeating pattern within the image, one of the factors that influence the roughness of the image is that a small amount of toner particles adhere irregularly around the image. This irregular adherence of toner particles tends to occur when the repeating pattern is of medium density. Once the density of the repeating pattern goes over a certain upper threshold, it looks to the human eye to be solid, and it becomes difficult to distinguish between the image portion within this solid part (one pattern) and the non-image portion (between patterns). This makes it less likely that the irregular adhesion of toner particles around the image portion will be seen as roughness. Conversely, once the density of the repeating patterns drops below a certain lower threshold, the patterns are so far apart that the irregular adhesion of toner particles looks to be incorporated into the patterns rather than looking like soiling between the patterns, and again is unlikely to be seen as roughness. Thus, with a digitally printed image, regardless of whether toner particles are irregularly adhering around the image portions, gradation locations where the average brightness L is less than 20 and gradation locations where the average brightness L is over 80 tend not to given an impression of roughness. Put another way, with an electrophotographic image forming apparatus, regardless of the performance thereof, gradation locations where the average brightness L is less than 20 and gradation locations where the average brightness L is over 80 will afford good image quality with no roughness.

On the other hand, there is a great difference in the RMS granularity σD of two grayscale images where the average brightness L is 20 to 80 (hereinafter referred to as halftone portion). It can be seen that the No. 1 test machine outputs a obviously good pattern with low roughness (a pattern with low RMS granularity σD). Thus, the roughness is generated mainly at the halftone portion where the average brightness L is 20 to 80. Consequently, even in the images which have been printed out by the same image forming apparatus, the image quality becomes good for the images with relatively low area ratio of the halftone portion, but the image quality becomes low with pronounced roughness for the images with relatively high area ratio of the halftone portion. Incidentally, the same result was obtained when the granularity GS was found instead of the RMS granularity σD. It was found that, even in the images which have been printed out by the same image forming apparatus, images with relatively good granularity GS or RMS granularity σD and images with low granularity are generated due to the difference in area ratio of the halftone portion as described above.

We can conclude from the above that properly ascertaining the performance of an electrophotographic image forming apparatus requires not that the overall roughness of a printed image be evaluated, but rather than the roughness be evaluated only in the halftone portion (average brightness L of 20 to 80).

Next, the inventors decided to evaluate the roughness of the above-mentioned grayscale image using an index other than the above-mentioned RMS granularity σD or granularity GS. Specifically, they first read an outputted grayscale image with a scanner (Nexscan 4100 made by Heidelberg) at a resolution of 1200 dpi. They then examined the granularity and the average brightness L at various area ratios. Granularity was calculated on the basis of the following Eq. 3, rather than using the RMS granularity σD or granularity GS discussed above. The average brightness L is the average of the various readings L*.

$$\text{Granularity}=\exp(aL+b)\int(WS_L(f))^{1/2}VTF(f)df+c \quad \text{Eq. 3}$$

Here, L is the average brightness, f is the spatial frequency (c/mm), $WS_L(f)$ is the power spectrum of brightness fluctuation, VTF(f) is the visual spatial-frequency characteristic, a is a coefficient (=0.1044), b is a coefficient (=0.8944), and c is a coefficient (=−0.262).

The NWS was found two-dimensionally using the average brightness L instead of the density D, after which this was one-dimensionalized and the roughness was evaluated. From this equation could be found a roughness index that was much better suited to color images or linearity of color space than the above-mentioned RMS granularity σD or granularity GS in which the density D was used. This granularity is discussed in detail in Japan Hardcopy '96, collected papers, p. 189, "Noise Evaluation of Halftone Color Images."

FIG. 5 illustrates an example of the relation between the area ratio of the image portion, the average brightness L, and the granularity obtained from Eq. 3 above.

It can be seen from FIG. 5 that the granularity at locations where the average brightness is from 40 to 80 is greater than the granularity at other locations. In FIG. 5, the average granularity is 0.32. In contrast, the average for just the six data (shown in bold) for which the average brightness L is between 40 and 80 is calculated to be 0.43. Thus, the difference is greater than 0.1.

Figure 6:
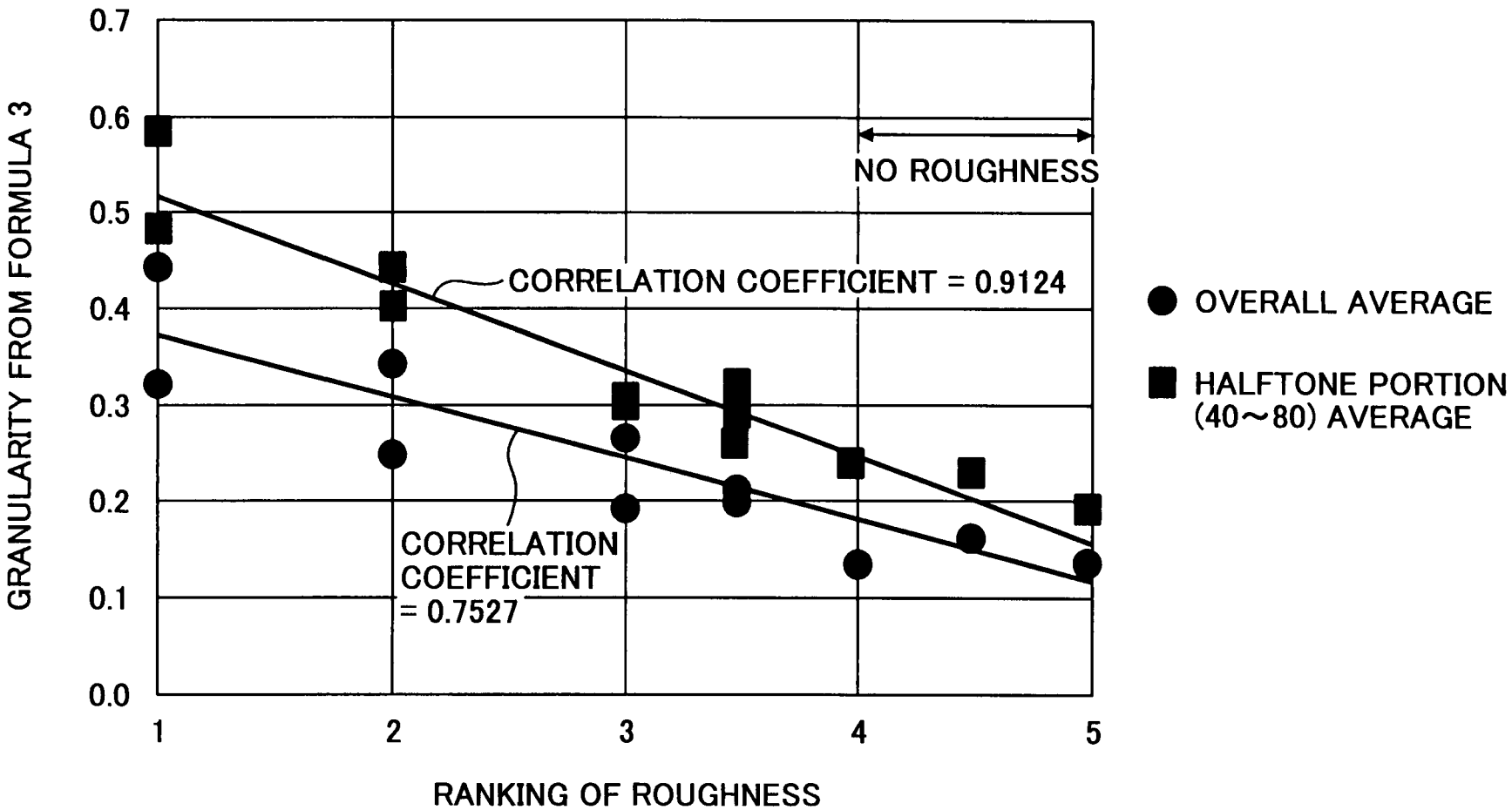
FIG. 6 is a graph of the relation between the subjective evaluation of roughness in a test-printed grayscale image, the average halftone granularity, and the average for granularity over the entire gradation.

Next, the average brightness L and the granularity obtained from Eq. 3 above were similarly measured for the above-mentioned grayscale image printed out by a variety of image forming apparatus test machines. The granularity was averaged for all 15 gradation area ratios, and the relation between this result and the result of averaging just the granularity at locations where the average brightness was 40 to 80 (hereinafter referred to as the halftone portion) was examined. The roughness of each grayscale image was also subjectively evaluated by a plurality of testers. These results are given in FIG. 6. In this graph, the greater is the numerical value of the rank (1 to 5) of roughness, the better (less grainy) is the image.

As shown in the graph, with an evaluation method in which the granularity is averaged for all 15 gradation area ratios, the correlation is poor between the rank of roughness and the average thereof (correlation coefficient=0.7527), which tells us that this is not suitable as an index of roughness. By contrast, with an evaluation method in which the granularity is averaged for just the halftone portion, the correlation between the rank of roughness and the average thereof is extremely good (correlation coefficient=0.9124), which indicates that this is excellent as an index of roughness. In this specification, this average value is defined as the average halftone granularity. Diligent research on the part of the inventors has revealed that there is no roughness if this average halftone granularity is 0.25 or less. Thus, as long as the average halftone granularity is no more than 0.25 after fixing on transfer paper or another such recording medium, there will be no perception of low quality to the human eye.

Meanwhile, with an electrophotographic image forming apparatus, quality generally deteriorates when a small amount of toner particles adhere irregularly around the image portion of the transfer paper or other recording medium during the transfer of the toner image to the recording medium immediately after developing. Also, when the toner image that has been transferred onto the recording medium is fixed thereto by close contact with a heating member, the image quality can deteriorate through situations such as the flattening of the toner particles, gloss, and the expansion of the adhesion region. Therefore, basically, to obtain a fixed toner image that does not look low-quality to the human eye, it is necessary to obtain a toner image whose average halftone granularity is 0.25 or less at the point of developing.

The average halftone granularity of a toner image immediately after developing must be found in order to evaluate whether or not the above applies. To this end, the toner image must be read with a scanner or other reading means from the latent image support (such as a photoreceptor) so as to put this image information in electronic form. It is extremely difficult, though, to read a toner image on a latent image support. The reason is that because of the curvature of the surface of the latent image support, the desired reading precision may not be attained, or the unfixed toner image may be smeared.

Figure 7:
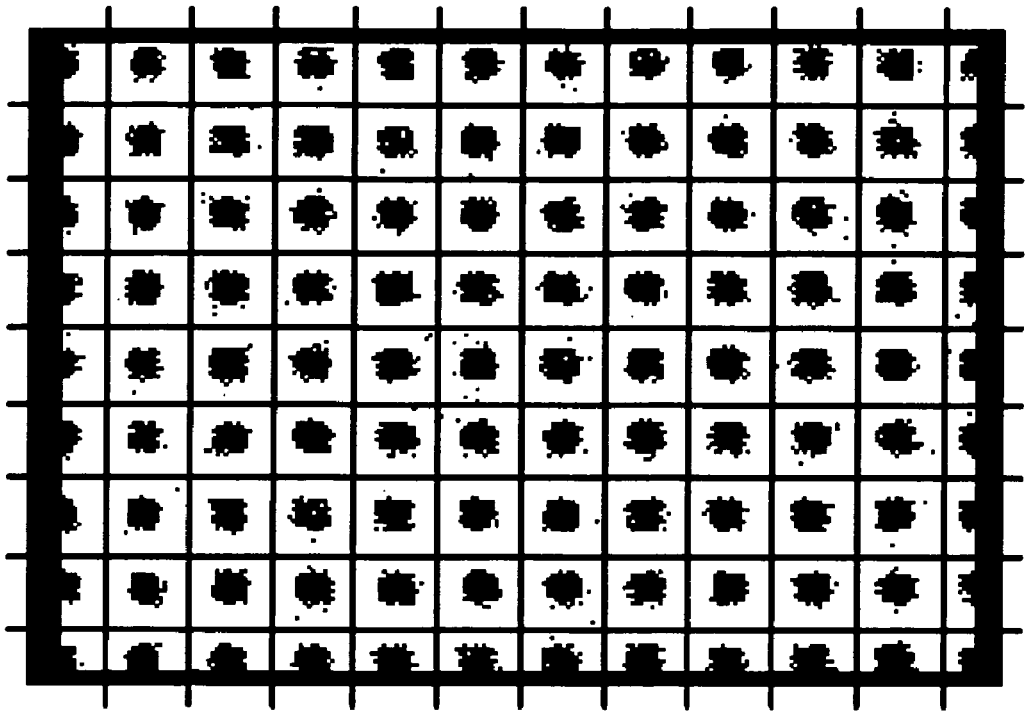
FIG. 7 is a schematic diagram illustrating a pattern image in which 70 patterns consisting of 2×2 dots are laid out in a matrix.
Figure 8:
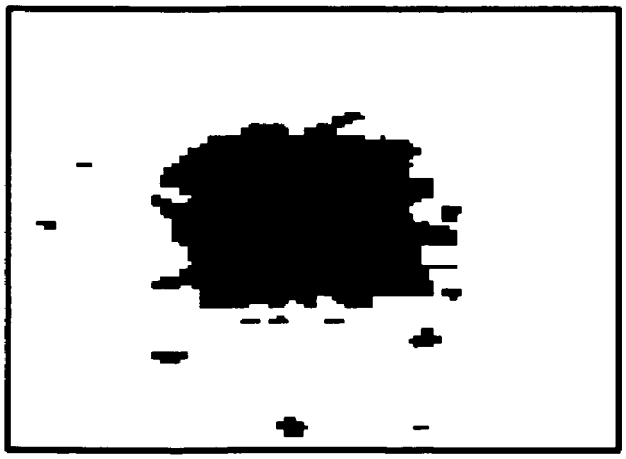
FIG. 8 is a schematic diagram illustrating the operation in which this pattern image is divided up at regular intervals by pattern.

In view of this, the inventors decided to estimate in the following manner the average halftone granularity of a toner image immediately after developing. First, a pattern image comprising 70 patterns consisting of 2×2 (=4) dots laid out in a matrix as shown in FIG. 7 was printed out (transferred and fixed) on transfer paper by an electrophotographic printer test machine. The printed paper thus obtained was then read with the above-mentioned scanner, after which the above-mentioned average halftone granularity was measured on the basis of this electronic data. The matrix of electronic data was then divided into a regularly spaced grid as shown in FIG. 7, each of the 70 divided data regions was binarized as shown in FIG. 8, and then the surface area of the portion where toner was adhered was analyzed and the standard deviation σ of the image portion area was calculated. This calculation was performed for each sheet of paper printed by a variety of kinds of test machine, and the relation between the standard deviation σ and the average halftone granularity was examined.

The same pattern image was then developed with each test machine, after which the machine was stopped before transfer from the photoreceptor to the transfer paper and allowed to stand for several hours, after which the photoreceptor was removed from the test machine. A film with a thickness of 0.1 mm and with holes in it corresponding to the read locations was placed on the contact glass of the scanner so as not to disturb the unfixed image on this transfer paper, the transfer paper was placed over this film so that the unfixed image did not come into contact with the contact glass, and the latent image was read with the scanner. The standard deviation σ of the image portion area and the average halftone granularity were then examined, after which the above-mentioned standard deviation σ for all data and the average halftone granularity were plotted in a two-dimensional plane along with the post-fixing data examined previously, to obtain an approximation line of the two.

The reason for measuring the average granularity and the a thereof after leaving the pattern image (immediately after developing) on the photoreceptor for several hours is as follows. When a photoreceptor is used as the latent image support, if the photoreceptor supporting the toner image immediately after developing is moved from inside the machine to a bright place on the outside, a sudden change in the potential of the background (non-exposure) portion of the photoreceptor is sometimes accompanied by scattering of the toner. In view of this, the photoreceptor is taken out into the bright light only after it has stood for several hours so that the charge of the background portion has sufficiently attenuated.

Figure 9:
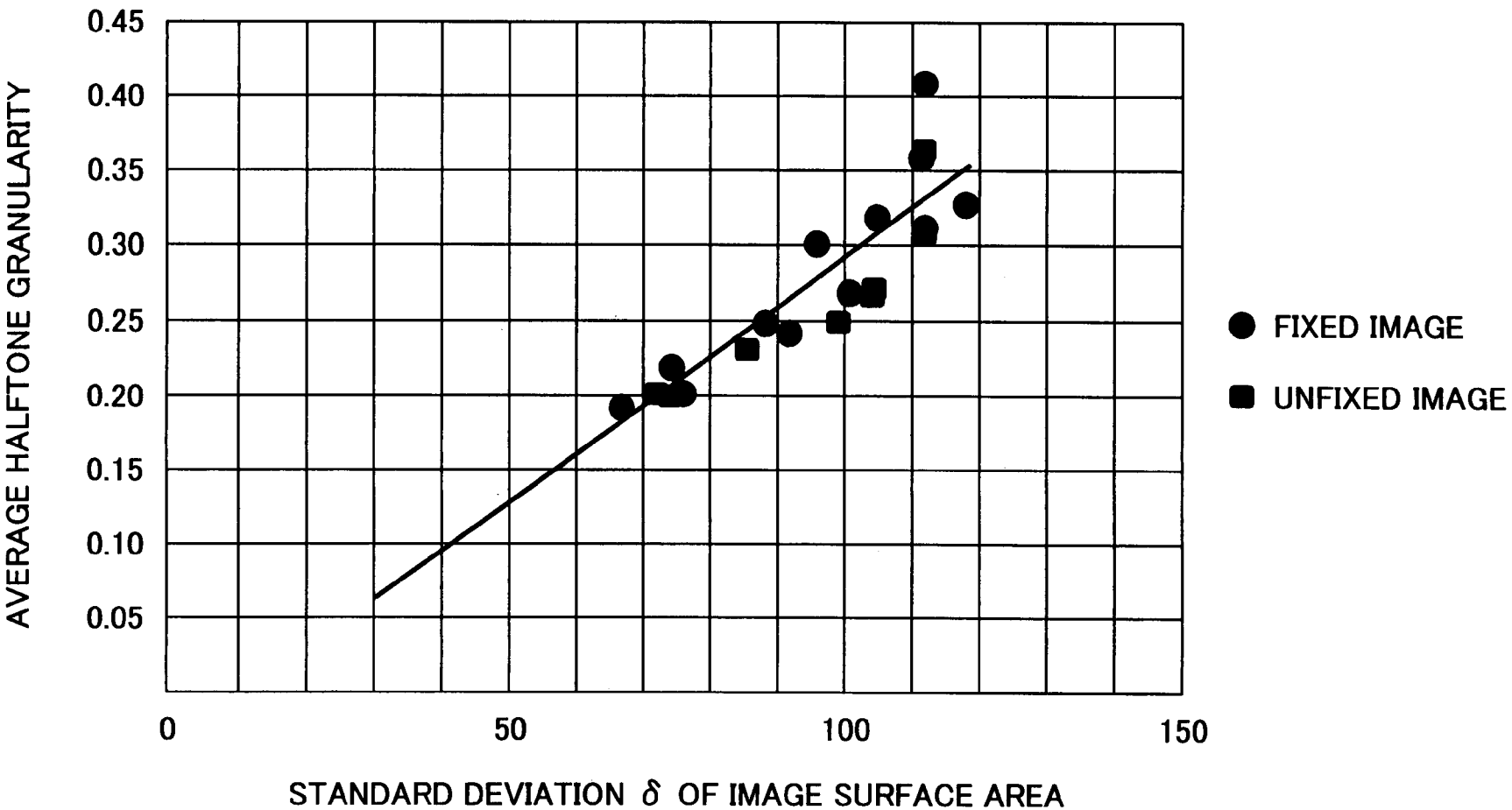
FIG. 9 is a graph of the relation between the standard deviation σ of the image surface area and the average halftone granularity.

FIG. 9 shows the above-mentioned approximation line. As seen in this graph, there is good correlation between the granularity estimated from the standard deviation σ of the image portion area based on the fixed image, and the granularity estimated from the standard deviation σ of the image portion area based on the unfixed image. Thus, the average halftone granularity of the image on the photoreceptor after developing but before transfer can be estimated by projecting the developed image on the photoreceptor in a microscope, calculating the standard deviation σ of the image portion area thereof, and plotting the calculation results on the graph of FIG. 9. In this Specification, this estimated value is defined as the estimated average halftone granularity of an image after developing but before transfer.

Embodiments of the Invention

An electrophotographic printer (hereinafter referred to as "printer"), which is an example of the image forming apparatus to which the various examples of the present invention are applied, will now be described.

Figure 10:
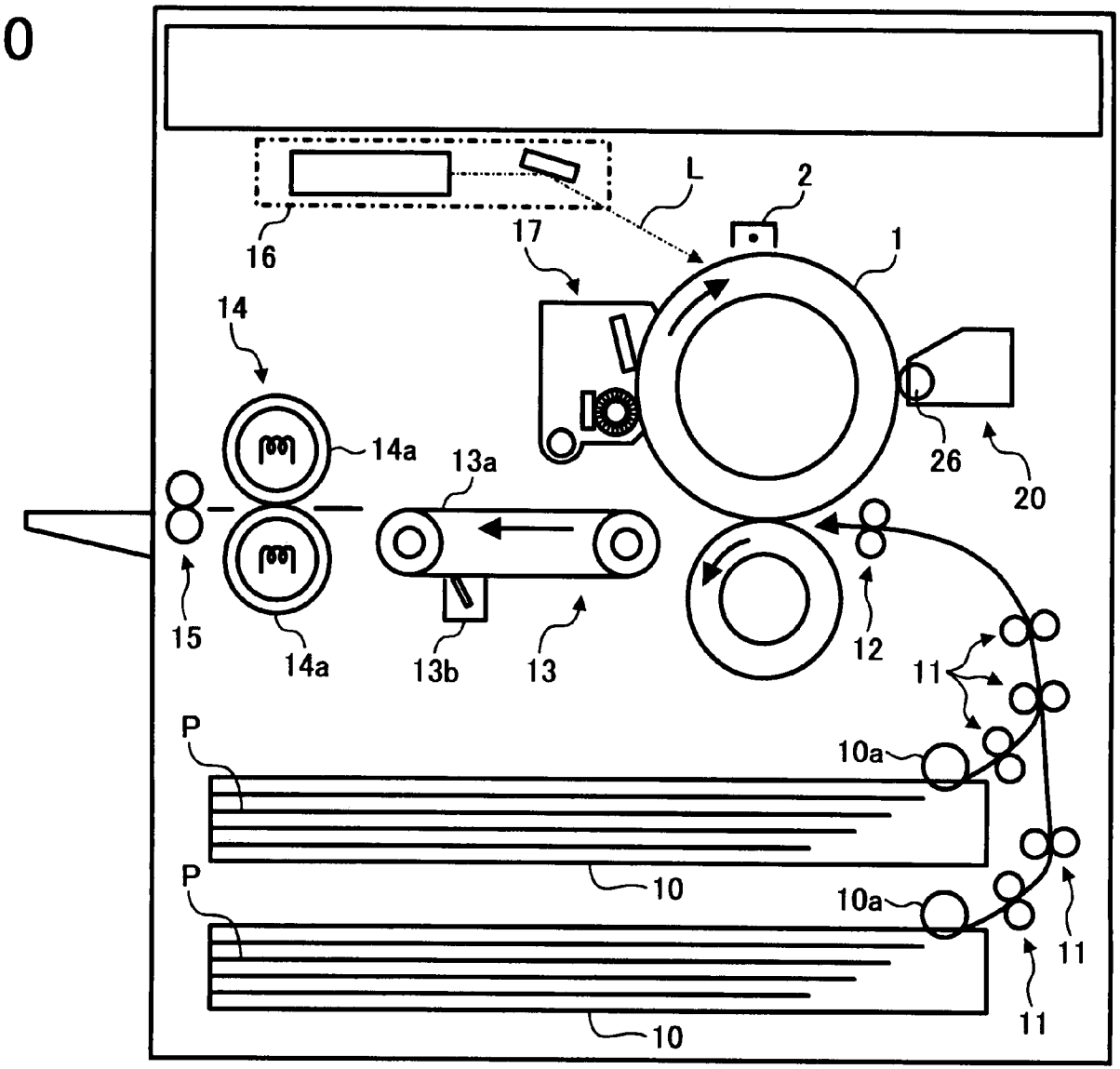
FIG. 10 is a diagram illustrating the simplified structure of a printer serving as the image forming apparatus in the examples of the present invention.

FIG. 10 is a diagram of the simplified structure of this printer. As shown in this drawing, a photoreceptor 1 (serving as the latent image support for supporting a latent image) is in the form of a drum with a diameter of 100 mm and having on its surface an organic photosensitive layer composed of amorphous or the like, and rotates clockwise in the drawing at a linear velocity of 330 mm/sec. The surface of this photoreceptor 1 is evenly charged by an electrostatic charger 2, after which a latent image is formed by scanning exposure on the basis of image information by a laser optical device 16. This image information is sent from a personal computer or the like (not shown). The latent image formed on the photoreceptor 1 is developed by a developing apparatus 20 to create a toner image, after which this toner image is electrostatically transferred onto transfer paper P (the recording medium) at a transfer nip (discussed below).

Figure 11:
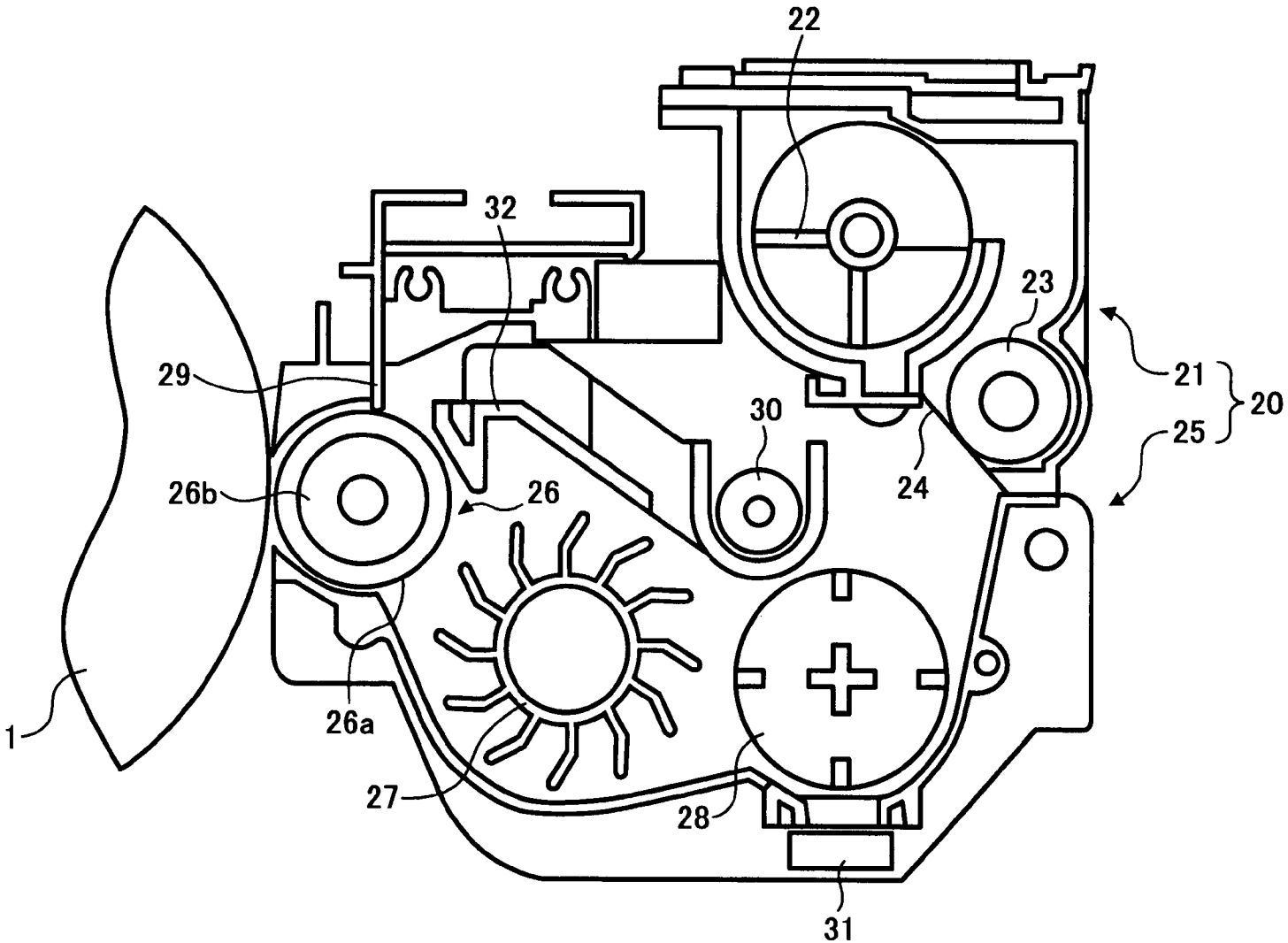
FIG. 11 is a diagram illustrating the structure of the photoreceptor and developing apparatus of this printer.

FIG. 11 illustrates the structure of the photoreceptor 1 and developing apparatus 20. As shown in this drawing, the developing apparatus 20, which is disposed to the side of the photoreceptor 1, comprises a toner feeder 21 and developer 25, which are designed so that they can be attached to and detached from each other. The toner feeder 21 has the function of housing toner inside, and has an agitator 22, a gear-like toner feed roller 23, a feed limiter 24, and so forth. The toner housed inside is loosened by the rotational drive of the agitator 22 while being sent to the toner feed roller 23. This toner is picked up by the toner feed roller 23, which is rotated by a drive system (not shown), and the thickness thereof on the roller is limited by the feed limiter 24, after which the toner is fed into the developer 25.

The developer 25 comprises a developing roller 26, an agitator paddle 27, an agitator roller 28, a limiting blade 29, a conveyor screw 30, a toner density sensor (hereinafter referred to as toner sensor) 31, and so forth. It also has a separator 32 disposed to the side of the developing roller 26. A two-component developing agent containing toner and a magnetic carrier composed of spherical ferrite with a diameter of 50 μm is contained inside the developer 25. The toner fed from the toner feeder 21 into the developer 25 drops onto the agitator roller 28, which is rotationally driven by a drive system (not shown). The agitator roller 28 mixes and agitates this dropped toner with the two-component developing agent, and sends [this mixture] toward the agitator paddle 27. In the course of this, the newly fed toner is frictionally charged by rubbing against the magnetic carrier, the agitator roller 28, and so on.

The agitator paddle 27, which is rotationally driven by a drive system (not shown), agitates the two-component developing agent inside the device, while sending it toward the developing roller 26. The developing roller 26 has a non-magnetic pipe 26*a* with a diameter of 25 mm, which is rotationally driven by a drive system (not shown), so that its surface moves at a linear velocity of 660 mm/sec in the same direction as the drum surface at the position where they are facing each other. The developing roller 26 also has a magnet roller 26*b* that is fixed on the inside of the pipe so as not to rotate together with the pipe, and on which are formed a plurality of magnetic poles separated in the circumferential direction. Of these magnetic poles, the peak magnetic force of the main developing magnetic pole located at the position facing the developing region (discussed below) is adjusted to 120 mT.

The developing roller 26 (the developing member) is designed such that part of its peripheral surface is exposed through an opening provided in its casing, and faces the photoreceptor 1. The two-component developing agent sent from the agitator paddle 27 is supported on the surface of the non-magnetic pipe 26*a* by the effect of the magnetic force generated by the magnet roller 26*b*. The supported two-component developing agent is picked up by the non-magnetic pipe 26*a*, and the thickness of the layer on the pipe is limited by the limiting blade 29, which is installed so as to maintain a specific gap with the developing roller 26 And then the two-component developing agent is conveyed to the developing region which is located at the position facing the photoreceptor.

A developing bias is applied by a power source (not shown) to the non-magnetic pipe 26*a*. As a result of this application, a developing potential that electrostatically moves the toner from the pipe side to the drum side acts between the non-magnetic pipe 26*a* and the electrostatic latent image of the photoreceptor 1 in the developing region. Also, a non-developing potential that electrostatically moves the toner from the drum side to the pipe side acts between the non-magnetic pipe 26*a* and the non-image portion (non-latent image portion) of the photoreceptor 1. Thus, the two-component developing agent conveyed to the developing region causes the toner to adhere only to the electrostatic latent image of the photoreceptor 1, and develops the electrostatic latent image into a toner image. The two-component developing agent that has passed through the developing region through the rotation of the non-magnetic pipe 26*a* of the developing roller 26 is recovered in a developer 101 through the rotation of the non-magnetic pipe 26*a*.

As discussed above, the thickness of the layer of two-component developing agent supported on the non-magnetic pipe 26*a* of the developing roller 26 is limited by the limiting blade 29. As a result, the two-component developing agent not picked up the non-magnetic pipe 26*a* is left behind on the upstream side (in the rotational direction of the pipe) of the limiting blade 29. This is then pushed by the two-component developing agent that follows, until it overflows over the separator 32 installed to the side of the developing roller 26. The overflowed two-component developing agent moves along the sloped upper surface of the separator 32 and is thereby guided toward the conveyor screw 30.

The conveyor screw 30 agitates and conveys the guided two-component developing agent in the axial direction thereof (away from the viewer in the drawing). This results in the so-called lateral agitation of the two-component developing agent. In contrast to this lateral agitation, the developing roller 26 and the agitator paddle 27 perform what is known as longitudinal agitation, in which the two-component developing agent is conveyed in the rotational direction thereof while being stirred. The conveyor screw 30 laterally agitates the two-component developing agent while dropping it onto the agitator roller 28. This dropping results in the longitudinal circulation of the two-component developing agent within the developer.

The toner sensor 31 is installed under the agitator roller 28, and outputs to a controller (not shown) a signal corresponding to the magnetic permeability of the two-component developing agent that is agitated and conveyed by the agitator roller 28. Since the toner density of the two-component developing agent is a function of the permeability, the toner sensor 31 ends up sensing the toner concentration of the two-component developing agent. The above-mentioned controller suitably operates the toner feeder 21 so that the output signal from the toner sensor 31 moves closer to a specific target value, thereby restoring the toner density of the two-component developing agent, which decreases as developing proceeds. However, since the magnetic permeability of the two-component developing agent varies with changes in the environment (such as humidity), changes in the bulk of the two-component developing agent, and so forth, the controller suitably corrects the above-mentioned target value. Specifically, it corrects the target value according to the density of a standard toner image formed on the photoreceptor 1 at a specific timing. This image density can be ascertained, for example, from the output of a reflective photosensor that senses the optical reflectance of the standard toner image.

As shown in FIG. 10, a transfer apparatus having a transfer roller 4, etc., is disposed under the photoreceptor 1. In addition to the transfer roller 4 shown in the drawing, this transfer apparatus also has a drive mechanism for rotationally driving this roller, a power source (not shown) for applying a transfer bias to the transfer roller 4, and so forth. The transfer roller 4 is rotationally driven so as to come into contact with the photoreceptor 1 at a specific pressure and form a transfer nip, while the surface thereof is moved by the contact portion in the same direction as the surface of the photoreceptor 1. A transfer electric field is formed by the effect of the transfer bias at this transfer nip. The toner image developed on the photoreceptor 1 moves into the transfer nip as the photoreceptor 1 rotates.

A plurality of paper feed cassettes 10 in which a plurality of sheets of transfer paper P (the recording medium) are stacked are disposed under the transfer apparatus so as to be stacked vertically over each other. These paper feed cassettes 10 feed the transfer paper P to the paper feed conveyance path when a paper feed roller 10*a* that is pressed against the uppermost sheet of transfer paper P is rotationally driven at a specific timing. Within the paper feed conveyance path, after the fed-out transfer paper P has gone past a plurality of conveyor roller pairs 11, it stops in between the rollers of a resist roller pair 12. The resist roller pair 12 sends out this sandwiched transfer paper P toward the transfer nip at a timing at which the paper will line up with the toner image formed on the photoreceptor 1 as discussed above. As a result, the toner image on the photoreceptor 1 and the transfer paper P fed out by the resist roller pair 12 are brought together synchronously. [The toner image] is electrostatically transferred onto the transfer paper P (what is being pressed against) by the effect of the above-mentioned transfer electric field and the nip pressure (transfer pressure).

A paper conveyance unit 13, for endlessly moving in the clockwise direction (in the drawing) a paper conveyor belt 13*a* looped around two rollers, is disposed to the left side (in the drawing) of the transfer roller. Further to the left of this paper conveyance unit 13 are disposed first a fixing apparatus 14 and then a paper discharge roller pair 15. The transfer paper P on which the toner image has been electrostatically transferred is sent from the transfer nip onto the paper conveyor belt 13*a* of the paper conveyance unit 13 by the rotation of the photoreceptor 1 and the transfer roller 4, and then enters the fixing apparatus 14. This fixing apparatus 14 has an internal heat source such as a halogen lamp, and a fixing nip is formed by a pair of fixing rollers 14*a* that rotate in contact with each other at the same speed. These fixing rollers 14*a* are maintained at a specific surface temperature (such as 165 to 185° C.) by switching the power supply to the heat source on and off on the basis of the sensing result of a surface temperature sensor (not shown) on each roller. The transfer paper P that has entered the fixing apparatus 14 is pinched in the transfer nip and subjected to heat and pressure treatments, which fixes the toner image onto the surface of the paper. The paper is then discharged from inside the fixing apparatus 14, through the paper discharge roller pair 15, to the outside of the machine.

Any residual toner image remaining on the surface of the photoreceptor 1 without being electrostatically transferred onto the transfer paper P at the transfer nip is removed from the photoreceptor 1 by a photoreceptor cleaner 17. After being thus cleaned, the surface of the photoreceptor 1 is electrically neutralized by a static eliminator (not shown), and then uniformly charged by the above-mentioned electrostatic charger. Any toner that has been transferred from the photoreceptor 1 onto the paper conveyor belt 13*a* at the transfer nip is removed from the paper conveyor belt 13*a* by a belt cleaning apparatus 13*b* of the paper conveyance unit 13.

The photoreceptor cleaner 17 has a zinc stearate coating means for coating the surface of the photoreceptor 1 with zinc stearate powder obtained by scraping a zinc stearate rod. Coating the surface of the cleaned photoreceptor 1 with zinc stearate powder lowers the coefficient of friction of the surface of the photoreceptor 1 and thereby improves transfer.

Figure 12:
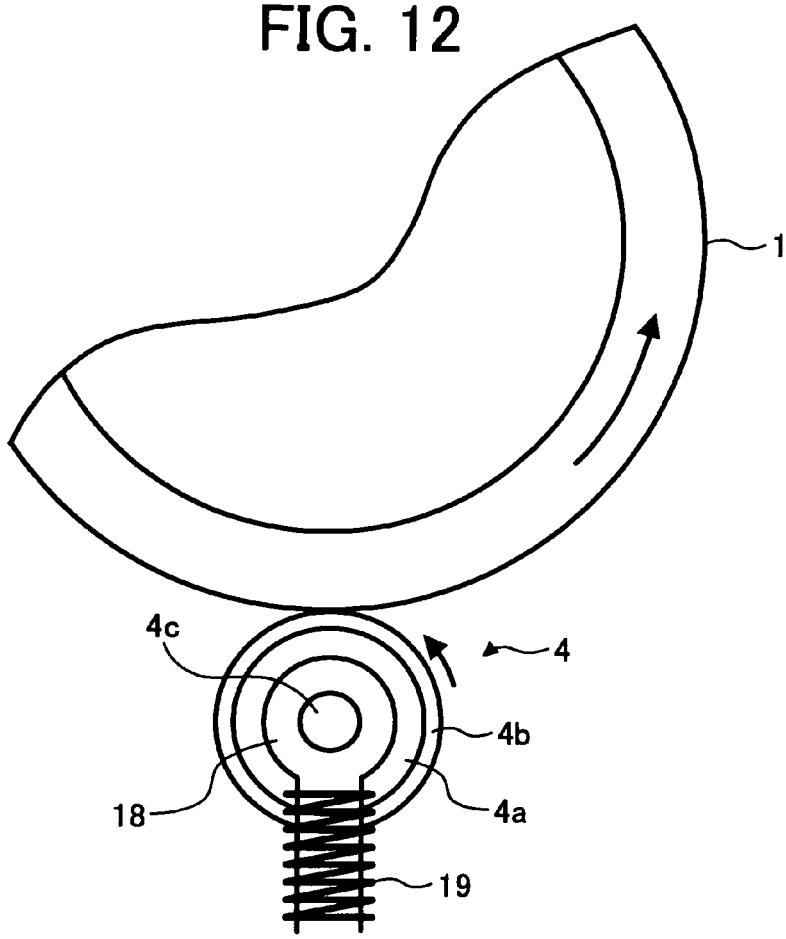
FIG. 12 is a side view illustrating the transfer nip and surroundings thereof of this printer.

FIG. 12 shows the transfer nip and surroundings thereof. As shown in the drawing, the transfer roller 4 that is pressed toward the photoreceptor 1 has a core roller (not shown) made of iron or the like and having a diameter of 20 to 30 mm, and a solid first elastic layer 4*a* that is made of EPDM, silicone, NBR, urethane, or the like and covers this core roller. This first elastic layer 4*a* is further covered with a second elastic layer 4*b* (which is softer than the first elastic layer), and the transfer roller 4 also has shafts 4*c* protruding from both ends of the core roller, and so forth. The shafts 4*c* at the ends are rotatably supported by bearings 18, and these bearings 18 are biased by springs 19 toward the photoreceptor 1. This biasing presses the transfer roller 4 toward the photoreceptor 1.

The second elastic layer 4*b* is adjusted to a thickness of 0.1 mm, a hardness (Asker C under 1 kg load) of 25 degrees, and a volumetric resistivity of $1\times10^{9}$ to $1\times10^{11}$ Ωcm. The first elastic layer 4*a* is adjusted to a thickness of 2.0 mm, a hardness (Asker C under 1 kg load) of 70 degrees, and a volumetric resistivity that is an order of magnitude lower than that of the second elastic layer 4*b*. If the hardness of the second elastic layer 4*b* is less than 15 degrees, this layer will be prone to permanent set. If the hardness of the second elastic layer 4*b* is over 40 degrees, though, elastic deformation will make it much more difficult to obtain a decrease in the above-mentioned air gap. If the hardness of the first elastic layer 4*a* is less than 60 degrees or its thickness is less than 0.5 mm, the desired increase in close contact between the photoreceptor 1 and the transfer paper P at the transfer nip will begin to drop precipitously.

The toner used in this printer can be one manufactured by a conventional method. For instance, one produced by pulverization can be used. Specifically, a binder resin, magnetic material, parting agent, colorant, and, if necessary, a charge control agent or the like are mixed in a mixer or the like, and then kneaded with a hot roll, extruder, or other such kneader. This product is then cooled and solidified, then pulverized with a jet mill, turbojet, Kryptron, or the like, after which it is graded to obtain a toner. The toner may also be manufactured by polymerization, for example. It is especially favorable to use a toner manufactured by polymerization using a modified polyester resin as the base material.

Figure 13:
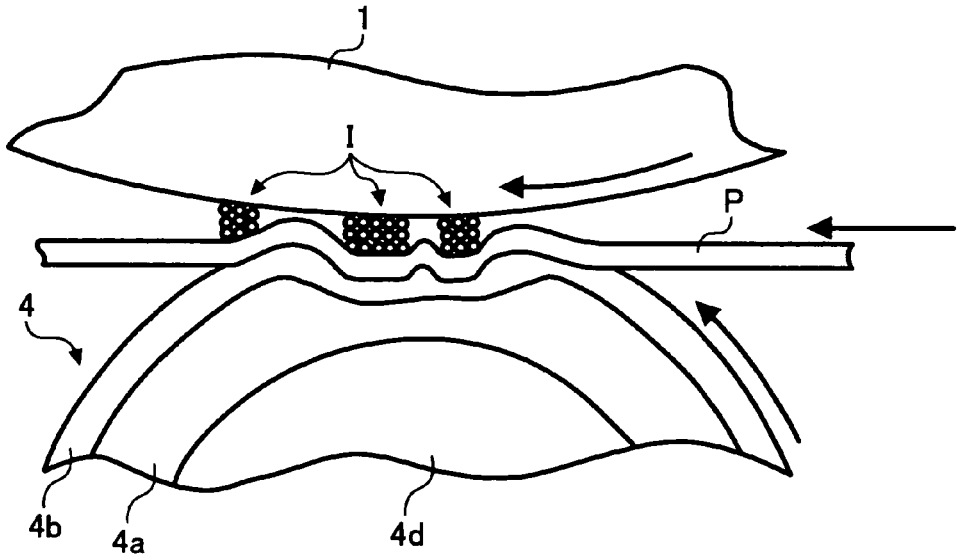
FIG. 13 is a schematic diagram illustrating the transfer nip formed by the photoreceptor of this printer and a transfer roller pressed with adequate pressure toward this photoreceptor.

FIG. 13 is a schematic diagram illustrating the transfer nip formed by the photoreceptor 1 and the transfer roller 4 pressed with adequate pressure toward this photoreceptor. As shown in the drawing, the first elastic layer first elastic layer 4*a* and second elastic layer 4*b* of the transfer roller 4 are soft enough to undergo elastic deformation at the transfer nip where the transfer roller 4 is pressed with adequate pressure toward this photoreceptor 1. As a result of this elastic deformation, the transfer paper P is pressed so that it not only comes into contact with the surface layer of the toner images I supported on the surface of the photoreceptor 1, but also conforms to the recesses between adjacent toner images I, which increases the close contact between the toner images I and the surface of the photoreceptor 1. Thus, the air gap formed between the photoreceptor 1 and the transfer paper P is decreased, which minimizes transfer dust within the transfer nip, and before and after the nip.

Examples of the present invention will now be described in detail.

First Embodiment

The inventors arrived at the concept of the printer pertaining to this embodiment on the basis of the experimental results of the experiment example described below. The basic composition of the toner used in this embodiment was as follows.

- polyester resin (weight average molecular weight: 185,000, Tg: 65° C.): 80 weight parts
- carnauba wax (average particle size: 300 μm): 4 weight parts
- carbon black (#44 made by Mitsubishi Chemical): 15 weight parts
- charge control agent (Spiron Black TR-H made by Hodogaya Chemical): 1 weight part This basic toner composition was kneaded at a temperature of 160° C. in a biaxial extruder, and then pulverized with a mechanical pulverizer to obtain toner particles. The pulverization here was conducted under various conditions. The toner particles obtained after pulverization were graded to obtain a considerable number of graded toners. Of these, those with weight average particle sizes of 4.2, 6.8, and 9.0 μm were selected, then each one that met the conditions given in FIGS. 14, 15, and 16 was selected, for a total of 48 types of graded toner.

The average circularity of the toner was measured as follows using an FPIA-2100 flow-type particle image analyzer made by Sysmex. A 1% NaCl aqueous solution was prepared using primary sodium chloride, after which this was filtered with a 0.45 μm filter. 0.1 to 5 mL of a surfactant, and preferably an alkylbenzenesulfonate, was added as a dispersant to 50 to 100 mL of the filtrate thus obtained, after which 1 to 10 mg of sample (toner powder) was added to this. The toner was dispersed for 1 minute with an ultrasonic disperser, which gave a test material with a toner concentration of 5000 to 15,000 particles/μL. The toner in this test material was photographed with a CCD camera, and the diameter of a circle having the same area as the toner particle area of the two-dimensional image thus obtained was found as the circle equivalent diameter. Toner particles for which this circle equivalent diameter was at least 0.6 μm were used as effective test particles in view of CCD photography precision to calculate the circularity thereof. This was done by dividing the circumference of a circle having the same projected area as the two-dimensional toner particle image produced by the CCD camera by the circumference of the projected image. The cumulative value for circularity of all particles was divided by the total number of toner particles to find the average circularity.

The degree of dispersion was measured as follows. First, a Coulter Multisizer 2e was set to an aperture diameter of 100 μm and used to measure the weight average particle size and number average particle size of the toner. The weight average particle size was divided by the number average particle size to find the degree of dispersion (degree of dispersion=weight average particle size/number average particle size). The weight average particle size was found by placing one microspatula of toner in a Coulter counter. The number average particle size was found as the average of 50,000 particles of each diameter obtained by Coulter counter.

Next, the surface of spherical ferrite with a weight average particle size of 50 μm was coated with a silicone resin, then heat-dried to obtain a magnetic carrier. The above-mentioned 48 types of toner powder were each mixed this magnetic carrier to produce 48 types of two-component developing agent. The ratio in which the toner and the magnetic carrier were mixed was varied according to the weight average particle size of the toner. In specific terms, toners whose weight average particle size was 4.2, 6.8, and 9.0 μm were mixed in respective amounts of 5.0, 4.0, and 3.0 wt % with respect to the magnetic carrier.

Figure 1:
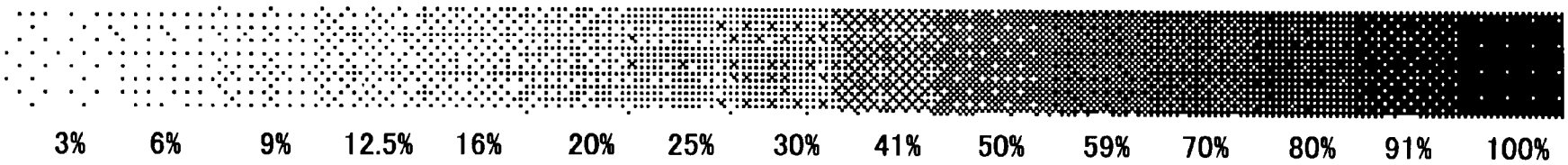
FIG. 1 is a schematic diagram illustrating the display of a grayscale image used in experiments conducted by the inventors.

Then, the inventors modified an electrophotographic printer (Imagio NE0750) made by Ricoh to produce a test printer with the same structure as that shown in FIG. 10. Using each of the above-mentioned 48 types of two-component developing agent, a grayscale image (see FIG. 1) was developed with this test printer, and the estimated average halftone granularity on the photoreceptor 1 was found by the same method as described above. FIGS. 17, 18, and 19 show the estimated average halftone granularity on the photoreceptor 1 for the above-mentioned grayscale image developing using toners with a weight average particle size of 4.2, 6.8, and 9.0 μm.

A comparison of FIGS. 17, 18, and 19 reveals that the larger is the weight average particle size of the toner, the greater is the estimated average halftone granularity, that is, the more pronounced the roughness is in the toner image after developing but before transfer. Also, with toners of a given weight average particle size, the smaller is the average circularity, or the greater the degree of dispersion, the more pronounced the roughness is in the toner image after developing but before transfer. Thus, to minimize roughness in the toner image after developing but before transfer, the weight average particle size of the toner should be as small as possible, its average circularity as large as possible, and its degree of dispersion as small as possible. However, as shown in FIGS. 17 and 18, it can be seen that regardless of the average circularity or degree of dispersion of the toner, the average halftone granularity after developing but before transfer can be kept to 0.25 or less as long as the toner has a weight average particle size of 4.2 to 6.8 μm In view of this, the various imaging conditions are set such that the estimated average halftone granularity of the toner image on the photoreceptor 1 after developing but before transfer will be 0.25 or less, as long as the toner has a weight average particle size of 4.2 to 6.8 μm. The user is also advised to use such a toner. Thus, as long as the recommended toner is used, it will be possible to reliably form a high-quality image of area ratio gradation, without the image appearing low in quality, at least after developing but before transfer.

The specification of the toner may be accomplished, for example, by packaging and shipping a toner whose weight average particle size is from 4.2 to 6.8 μm along with the printer (image forming apparatus). This may also be accomplished, for example, by marking the printer unit, its instruction manual, etc., with the stock number, merchandise name, and so forth of such toner. Alternatively, it can be accomplished, for example, by notifying the user of the above-mentioned stock number, merchandise name, and so forth in writing, by electronic data, or the like. Another way it can be accomplished is to ship the printer with such a toner already installed in the toner housing means inside the printer.

Next, a first modification of the printer pertaining to this embodiment will be described.

The inventors arrived at the concept of the printer pertaining to this modification on the basis of the experimental results of the experiment example described below.

First, nine types of toner (Nos. 1, 7, 16, 17, 25, 32, 33, 38, and 48) were selected from among the 48 types listed in FIGS. 17, 18, and 19. Next, a grayscale image (see FIG. 1) was developed with a test printer using each of these toners. The printing operation of the test machine was halted before the transfer paper P on which the grayscale image had been electrostatically transferred moved into the fixing apparatus 14, and 9 sheets of transfer paper P on which an unfixed grayscale image was supported (hereinafter referred to as "unfixed transfer paper") were obtained. This same experiment was conducted under four different transfer nip pressure conditions and four different transfer current conditions, so that a total of 144 sheets of unfixed transfer paper were obtained (9 types of toner×4 different transfer nip pressure conditions×4 different transfer current conditions). The four different transfer nip pressure conditions comprised 0.04, 0.20, 1.00, and 2.00N/mm$^2$. The four different transfer current conditions comprised 10, 20, 200, and 400 nA/mm$^2$.

The average halftone granularity of the grayscale image was measured for each of the 144 sheets of unfixed transfer paper obtained above. Since the grayscale images were unfixed here, there was the danger that the images would be smudged during reading by the scanner, and therefore films with a thickness of 0.1 mm and with measurement holes in them were first readied, these films were applied to the image-supporting side of the unfixed transfer paper, and only then was the film-bonded side put in contact with the bed of the scanner (Nexscan 4100 made by Heidelberg). The film thus functioned as a spacer so that the region of the grayscale image to be measured did not touch the scanner bed, and [the image] was read at a resolution of 1200 dpi. The average halftone granularity of the grayscale image after developing but before fixing was found on the basis of the electronic data thus obtained.

The transfer ratio of the grayscale image after developing but before fixing was also found as follows. First, the printing operation was halted at the point when the grayscale image had been electrostatically transferred from the photoreceptor 1 to the transfer paper P, and the toner remaining in the photoreceptor 1 region where the grayscale image had up to then been supported was collected with adhesive tape. The adhesive tape was then weighed, and the amount of residual toner was calculated by subtracting from this measurement value the weight of just the adhesive tape, which had been measured in advance before the toner collection. Next, the transfer paper P to which the toner image had been transferred was cut out where the image was, and the resulting piece of paper was weighed. The grayscale image on this piece of paper was then sprayed with compressed air to blow away nearly all of the toner, after which the piece of paper was weighed again, the later weight was subtracted from the earlier weight, and this remainder was termed the amount of transferred toner. The amount of residual toner after transfer and the amount of transferred toner thus found were added together, and this sum was termed the total amount of toner. The transfer ratio was found on the basis of the following Eq. 4.

$$\text{Transfer ratio} = \text{amount of transferred toner}/\text{total amount of toner} \times 100\ (\%) \qquad \text{Eq. 4}$$

FIGS. 20 and 21 are tables of the properties of toners whose weight average particle size is 4.2 μm and 6.8 μm, and the average halftone granularity and transfer ratio in a grayscale image on unfixed transfer paper obtained using each toner.

It can be seen from a comparison of the increase in granularity due to electrostatic transfer in FIGS. 20 and 21 that, if we look only at electrostatic transfer, the weight average particle size of the toner has little effect on the average halftone granularity. Also, it can be seen from a comparison of average circularity or degree of dispersion with the increase in granularity due to electrostatic transfer in FIGS. 20 and 21 that, if we look only at electrostatic transfer, the average circularity or degree of dispersion of the toner also has little effect on the average halftone granularity. Since the weight average particle size, average circularity, and degree of dispersion each has a major effect in the developing step prior to electrostatic transfer, the average halftone granularity of the grayscale image after transfer must vary greatly with the average circularity or degree of dispersion. Thus, if we look only at electrostatic transfer, the weight average particle size, average circularity, and degree of dispersion of the toner are not all that critical.

In contrast, it can be seen from a comparison of transfer nip pressure or transfer current with the increase in granularity due to electrostatic transfer in FIGS. 20 and 21 that the former has a major effect on the latter. Specifically, if either the transfer nip pressure or the transfer current is too low or too high, the average halftone granularity of the grayscale image after transfer will be much worse.

The reason the average halftone granularity of the grayscale image after transfer will be much worse if the transfer nip pressure is too low is believed to be that, as discussed above, during electrostatic transfer, there is a considerable amount of image scatter caused by a small amount of toner particles adhering around the image portion of the transfer paper P (hereinafter referred to as transfer dust). In the past, the cause of this transfer dust was believed to be that a small amount of toner was scattered from the toner image on the photoreceptor 1 before and after the transfer nip in a state in which the transfer paper P was not pinched in the transfer nip, and adhered to the transfer paper P not pinched in the transfer nip. However, diligent research on the part of the inventors has revealed that even if no toner is scattered from the toner image on the photoreceptor 1 before and after the transfer nip, transfer dust still occurs on the transfer paper P that has gone through the transfer step. This indicates that transfer dust is being generated within the transfer nip as well. The reason for this seems to be that tiny gaps are formed within the transfer nip.

More specifically, even though the toner supporting regions on the surface of the photoreceptor 1 are in close contact with the transfer paper P within the transfer nip, the toner non-supporting regions in between these toner supporting regions may not be in close contact with the transfer paper P. It is believed that tiny gaps are formed between the transfer paper P and these toner non-supporting regions, and that this is where the transfer dust occurs.

In view of this, the transfer roller 4 used with this printer is provided with elastic layers (the first elastic layer 4*a* and second elastic layer 4*b*). At the transfer nip, these elastic layers are flexibly deformed so as to conform to the tiny bumps and recesses formed by the above-mentioned toner supporting regions and toner non-supporting regions, and this reduces the formation of the above-mentioned tiny gaps. Nevertheless, even if these elastic layers are provided, if the transfer nip pressure is set too low, the layers will not be able to deform flexibly, and a considerable amount of transfer dust will end up being generated at the above-mentioned tiny gaps. This is believed to be the reason the average halftone granularity of the grayscale image after transfer is much worse if the transfer nip pressure is set too low.

The reason the average halftone granularity of the grayscale image after transfer is much worse if the transfer nip pressure is too high is believed to be that quite a few of the toner particles in contact with the photoreceptor 1 at the surface of the toner image remain on the photoreceptor 1, without moving to the transfer paper P side along with the underlying particles. The amount of these toner particles tends to increase with the transfer nip pressure, and if the amount is too large, it results in what is known as a "hanga [woodblock printing]" phenomenon, in which dropped-out white portions occur in the toner image after transfer. If the transfer nip pressure is too high, this phenomenon worsens to the point of being recognizable as roughness.

Also, the reason the average halftone granularity of the grayscale image after transfer is much worse if the transfer current is too low is that, as shown in FIGS. 20 and 21, the transfer ratio increases in proportion to the transfer current. If the transfer current is too low, not enough toner will be transferred to avoid roughness, and the average halftone granularity will be much worse.

The reason the average halftone granularity of the grayscale image after transfer is much worse if the transfer current is too high is that the transfer ratio is also correlated to the amount of the above-mentioned transfer dust, and the higher is the former, the greater is the amount of the latter. If the transfer current is too high, transfer dust will be generated that causes severe roughness.

While not shown in the drawings, with a toner whose weight average particle size is 9.0 μm, the average halftone granularity of the grayscale image after transfer exceeded 0.25 regardless of the transfer nip pressure or transfer current. The reason here is that the estimated average halftone granularity of the toner image after developing but before transfer was very poor, and as a result the average halftone granularity after transfer ended up being over 0.25.

Thus, to obtain good image quality that is free of roughness in a toner image after transfer but before fixing, a toner with good properties must be used and developing performed so that the estimated average halftone granularity after developing will be as good as possible. An examination of this on the basis of FIGS. 20 and 21 reveals that the following conditions must be met.

The toner must have a weight average particle size of 4.2 to 6.8 [μm], an average circularity of at least 0.98, and a degree of dispersion of 1.10 or less.

The electrostatic transfer must be performed at a transfer current of 20 to 400 nA/mm$^2$.

The transfer nip must be formed by pressing the transfer roller 4 against the photoreceptor 1 at a pressure of 0.20 to 1.00 N/mm$^2$.

In view of the above, for the printer pertaining to this embodiment, the user is advised to use a toner with a weight average particle size of 4.2 to 6.8 μm, an average circularity of at least 0.98, and a degree of dispersion of 1.10 or less. Also, the transfer current is set at 20 to 400 nA/mm$^2$, and the transfer nip pressure is set at 0.20 to 1.00 N/mm$^2$. Thus, as long as the recommended toner is used, an image with area ratio gradation can be reliably formed at a high level of quality, that at least gives no impression of low quality after transfer but before fixing. The methods for specifying this toner are the same as for the printer in the embodiments.

Figure 22:
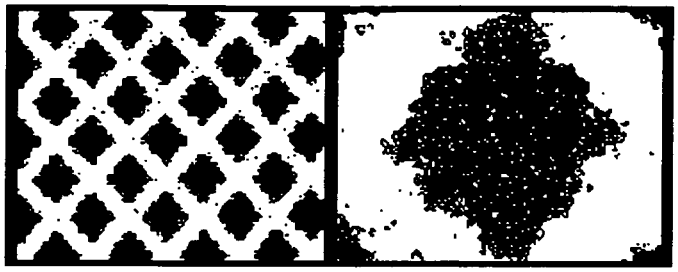
FIGS. 22 to 24 are schematic diagrams of grayscale images whose average halftone granularity is 0.20, 0.40, and 0.90 after transfer but before fixing, with toners whose weight average particle size is 4.2 μm, 6.8 μm, and 9.0 μm.
Figure 23:
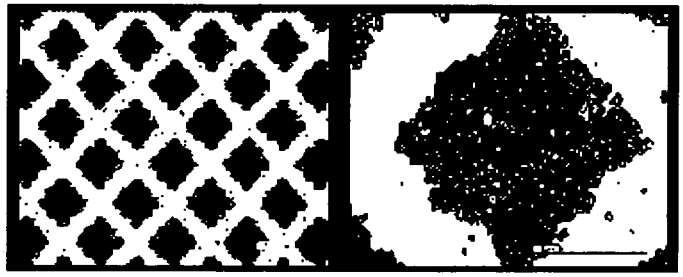
Figure 24:
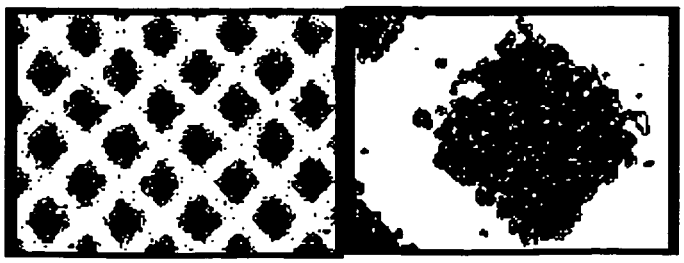

For the sake of reference, FIGS. 22, 23, and 24 respectively show grayscale images in which the average halftone granularity is 0.20, 0.49, and 0.90 after transfer but before fixing, for toners whose weight average particle size is 4.2, 6.8, and 9.0 μm.

A second modification of the printer pertaining to this embodiment will now be described.

The inventors arrived at the concept of the printer pertaining to this modification on the basis of the experimental results of the experiment example described below. First, two types of toner (Nos. 1 and 7 shown in FIG. 20) were used to print grayscale images while the transfer conditions and fixing conditions were varied. The transfer nip pressure here was varied between two levels of 0.20 and 1.00 N/mm$^2$, while the transfer current was varied between two levels of 20 and 200 nA/mm$^2$. The fixing conditions were varied three ways, such that one of the following three rollers was used as the fixing roller 14*a* that was in close contact with the toner image, that is, the one that functioned as the heating member.

① A roller comprising a surface layer composed of silicone rubber with a thickness of 1 mm and a hardness (Asker C under 1 kg load) of 25 degrees provided over a core roller.

② A roller comprising an intermediate layer composed of silicone rubber with a thickness of 200 μm provided over a core roller, and a surface layer composed of a polytetrafluoroethylene resin with a thickness of 20 μm provided over this intermediate layer. Hereinafter this will be referred to as a Teflon (trademark) surface elastic roller. The combined two-layer hardness on the core roller of this roller was 70 degrees (Asker C under 1 kg load).

③ A roller comprising a surface layer composed of a polytetrafluoroethylene resin provided over a core roller (hereinafter referred to as a Teflon surface rigid roller).

The fixing roller 14*a* that was not in close contact with the toner image comprised an intermediate layer composed of silicone rubber with a thickness of 5 mm provided over a core roller, and a surface layer composed of a polytetrafluoroethylene resin with a thickness of 20 μm provided over this intermediate layer.

FIG. 25 is a table showing the relation between the toner properties, the transfer conditions, the fixing conditions, and the average halftone granularity (or estimated value thereof) at each step of the grayscale images.

It can be seen from FIG. 25 that unless ① above is used as the fixing roller in contact with the toner image, the average halftone granularity during fixing will be much worse, and it will be difficult to obtain a final fixed image with an average halftone granularity of 0.25 or less. It can also be seen that a final fixed image with an average halftone granularity of 0.25 or less can be obtained if the conditions listed below are met. These conditions merely indicate the ranges covered by the experiment, and it should go without saying that it may be possible to obtain such a fixed image outside of these ranges.

The fixing roller 14*a* that is in contact with the toner image must be as defined in ① above.

The toner must have a weight average particle size of 4.2 to 6.8 [μm], an average circularity of at least 0.98, and a degree of dispersion of 1.10 or less.

The transfer current must be set between 20 and 200 $nA/mm^2$.

The transfer nip pressure must be set between 0.20 and 1.00 $N/mm^2$.

In view of the above, for the printer pertaining to this modification, the user is advised to use a toner with a weight average particle size of 4.2 μm, an average circularity of at least 0.98, and a degree of dispersion of 1.10 or less, just as in this embodiment. Also, just as in this embodiment, the transfer nip pressure is set between 0.20 and 1.00 $N/mm^2$. Furthermore, unlike in this embodiment, the transfer current is set between 20 and 200 $nA/mm^2$, and the fixing roller 14*a* that is in contact with the toner image is the one defined in 01 above. Thus, as long as the recommended toner is used, an image with density gradation can be reliably formed at a high level of quality, that at least gives no impression of low quality in the state after fixing.

Figure 26:
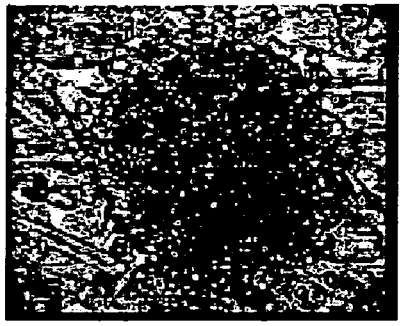
FIGS. 26 to 28 are schematic diagrams of the image portions of grayscale images in which the increase in granularity during fixing is 0.04, 0.10, and 0.15.
Figure 27:
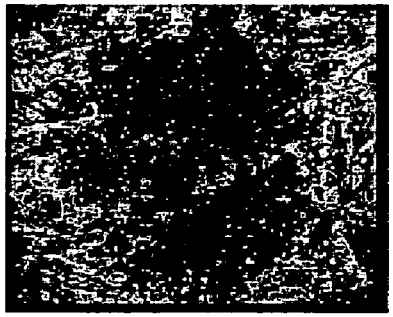
Figure 28:
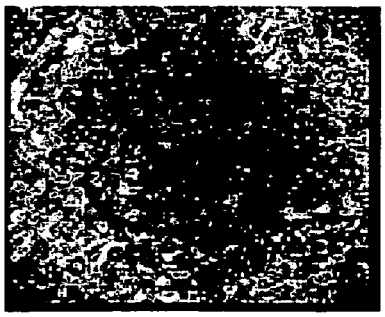

For the sake of reference, FIGS. 26, 27, and 28 are detail views of the image portion of grayscale images in which the increase in granularity during fixing is 0.04, 0.10, and 0.15, respectively.

With the printer pertaining to this embodiment, the toner used to form the toner image is specified to have a weight average particle size of 4.2 to 6.8 μm, so as long as this toner is used, an image with density gradation can be reliably formed at a high level of quality, that at least gives no impression of low quality in the state after developing but before transfer.

Also, with the printer pertaining to this embodiment, because the average halftone granularity of the toner image after electrostatic transfer but before fixing is 0.25 or less, an image with density gradation can be reliably formed at a high level of quality, that at least gives no impression of low quality in the state after transfer but before fixing.

Further, the toner used to form the toner image is specified to have a weight average particle size of 4.2 to 6.8 μm, an average circularity of at least 0.98, and a degree of dispersion of 1.10 or less, the transfer current is set between 20 and 400 $nA/mm^2$, and the transfer nip pressure is set between 0.20 and 1.00 $N/mm^2$. Thus, as long as the recommended toner is used, an image can be reliably formed at a high level of quality, that at least gives no impression of low quality in the state after developing but before fixing.

Also, with the printer pertaining to this embodiment, because the average halftone granularity of the toner image after fixing is 0.25 or less, an image with density gradation can be reliably formed at a high level of quality, that at least gives no impression of low quality in the state after fixing.

Further, the transfer current was set between 20 and 200 $nA/mm^2$, and the fixing roller 14*a* that was in contact with the toner image was covered on its surface with silicone rubber. Thus, as long as the recommended toner is used, an image can be reliably formed at a high level of quality, that at least gives no impression of low quality in the state after fixing.

Second Embodiment

FIGS. 1 to 13, 22 to 24, and 26 to 28 referred to in the first embodiment, as well as the descriptions thereof, are substantially applicable just as they are to this embodiment, and so will not be described again, and mainly just the distinguishing characteristics of the present invention relevant to this embodiment will be described.

The inventors arrived at the concept of the printer pertaining to this embodiment on the basis of the experimental results of the experiment example described below. First, six types of toner (A to F) were manufactured.

Toner A was manufactured as follows.

Synthesis of Toner Binder 724 weight parts of a 2 mol ethylene oxide adduct of bisphenol A, 276 weight parts isophthalic acid, and 2 weight parts dibutyltin oxide were put in a reaction tank equipped with a condenser pipe, a stirrer, and a nitrogen introduction pipe. A polycondensation reaction was conducted for 8 hours at normal pressure and 230° C., after which the pressure was reduced to between 10 and 15 mmHg and the reaction continued for another 5 hours. The system was then cooled to 160° C., after which 32 weight parts phthalic anhydride was added and reacted for 2 hours. The system was further cooled to 80° C., after which the system was reacted for 2 hours with 188 weight parts isophorone diisocyanate in ethyl acetate, which gave a prepolymer containing an isocyanate. Then, 267 weight parts of this isocyanate-containing prepolymer and 14 weight parts isophoronediamine were reacted for 2 hours at 50° C. to obtain a urea-modified polyester (1) with a weight average molecular weight of 64,000.

Meanwhile, 724 weight parts of a 2 mol ethylene oxide adduct of bisphenol A and 276 weight parts terephthalic acid were subjected to a polycondensation reaction for 8 hours at normal pressure and 230° C. by the same procedure as described above. The pressure was then reduced to between 10 and 15 mmHg and the reaction continued for another 5 hours, which gave an unmodified polyester (a) with a peak molecular weight of 5000. A 1:1 mixed solvent of ethyl acetate and methyl ethyl ketone (hereinafter referred to as MEK) was then readied. 200 weight parts of the above-mentioned urea-modified polyester (1) and 800 weight parts of the above-mentioned unmodified polyester (a) were dissolved and mixed in this mixed solvent to obtain a solution of a toner binder (A). Part of this was dried under reduced pressure to isolate the toner binder (A), which had a glass transition temperature (hereinafter referred to as Tg) of 62° C. and an acid value of 10.

Synthesis of Toner 240 weight parts of a solution of the above-mentioned toner binder (A), 20 weight parts pentaerythritol tetrabehenate (melting point 81° C., melt viscosity 25 cps), and 10 weight parts carbon black were put in a beaker. The contents were stirred at a speed of 12,000 rpm with a TK homogenizer at a temperature of 60° C. until uniformly dissolved and dispersed. This product was termed the toner material solution. 706 weight parts deionized water, 294 weight parts of a 10% suspension of hydroxyapatite (Supertite 10 made by Nippon Chemical Industries), and 0.2 weight part sodium dodecylbenzenesulfonate were then put in another beaker and uniformly dissolved. This solution was heated to 60° C. and then stirred at a speed of 12,000 rpm with a TK homogenizer while the above-mentioned toner material solution was added. The stirring was continued for 10 minutes.

This mixture was then transferred to a conical flask equipped with a stirring rod and a thermometer, and heated to 98° C. to remove part of the solvent. The mixture was returned to room temperature, then stirred at a speed of 12,000 rpm with a TK homogenizer to adjust the shape of the toner particles, after which the rest of the solvent was removed. This product was then filtered, washed, and dried, then subjected to air separation to obtain matrix toner particles. 100 weight parts these matrix toner particles were mixed with 0.5 weight part hydrophobic silica in a Henschel mixer to obtain a toner A. The shape factor SF-1 of this toner A was 140, its average circularity was 0.92, its degree of dispersion was 1.39, and its cohesion was 25%.

The shape factor SF-1 is an index of the roundness of the particles, and can be found as follows. A microscope apparatus such as an FE-SEM (S-80) made by Hitachi is used to obtain a viewing area with a magnification of 1000 times. 100 toner particles are sampled at random from this magnified viewing area, and the images thereof are successively projected. The electronic data for the projected images thus obtained is transmitted to an image analyzer such as a Luzex III made by Nicolet, the absolute maximum length MXLNG and projected area AREA for each particles are analyzed, and the average values thereof are calculated.

Figures 29, 30:
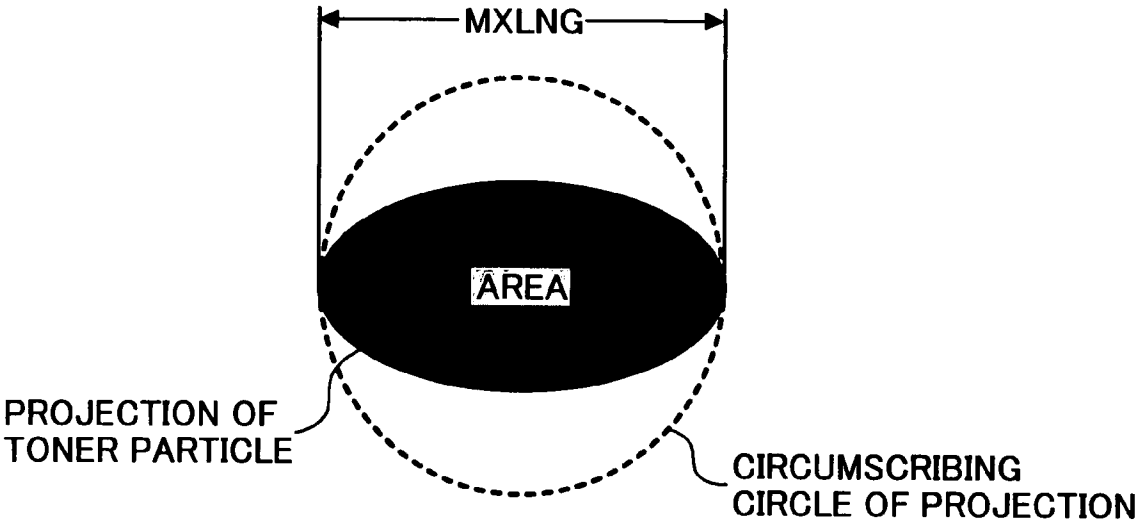

This absolute maximum length MXLNG is the length at the place of maximum diameter in a two-dimensional projection of the toner particle as shown in FIG. 29. If the particle is a true ellipse, this is the length of the major diameter. The shape factor. SF-1 can be found by plugging the resulting absolute maximum length MXLNG and projected area AREA into the following equation and calculating the average for 100 toner particles. The shape factor SF-1 of a sphere is 100.

$$SF\text{-}1=(MXLNG)^2/AERA\times(\pi/4)\times 100 \qquad \text{Eq. 5}$$

The average circularity of the toner was measured as follows using an FPIA-2100 flow-type particle image analyzer made by Sysmex. A 1% NaCl aqueous solution was prepared using primary sodium chloride, after which this was filtered with a 0.45 μm filter. 0.1 to 5 mL of a surfactant, and preferably an alkylbenzenesulfonate, was added as a dispersant to 50 to 100 mL of the filtrate thus obtained, after which 1 to 10 mg of sample (toner powder) was added to this. The toner was dispersed for 1 minute with an ultrasonic disperser, which gave a test material with a toner concentration of 5000 to 15,000 particles/μL. The toner in this test material was photographed with a CCD camera, and the diameter of a circle having the same area as the toner particle area of the two-dimensional image thus obtained was found as the circle equivalent diameter. Toner particles for which this circle equivalent diameter was at least 0.6 μm were used as effective test particles in view of CCD photography precision to calculate the circularity thereof. This was done by dividing the circumference of a circle having the same projected area as the two-dimensional toner particle image produced by the CCD camera by the circumference of the projected image. The cumulative value for circularity of all particles was divided by the total number of toner particles to find the average circularity.

The degree of dispersion of the toner was found by dividing the weight average particle size of the toner by the number average particle size. The diameter of these particles was measured by using a Coulter Multisizer 2e and installing an aperture with a diameter of 100 μm.

The cohesion of the toner was measured using a powder tester (model PT-N made by Hosokawa Micron). This measurement was basically carried out according to the instruction manual of the tester, with the exception of the changes listed below.

Sieves used: tests were conducted using three types of sieves of 75, 45, and 22 μm.

Vibration time: 30 seconds

Next, toner B was manufactured as follows.

Synthesis of Toner Binder 334 weight parts of a 2 mol ethylene oxide adduct of bisphenol A, 334 weight parts of a 2 mol propylene oxide adduct of bisphenol A, 274 weight parts isophthalic acid, and 20 weight parts trimellitic anhydride were mixed and then subjected to polycondensation in the same manner as with toner A, after which this product was reacted with 154 weight parts isophorone diisocyanate to obtain a prepolymer. 213 weight parts of this prepolymer, 9.5 weight parts isophoronediamine, and 0.5 weight part dibutylamine were then reacted in the same manner as with toner A, which gave a urea-modified polyester (2) with a weight average molecular weight of 79,000. Next, 200 weight parts of this urea-modified polyester (2) and 800 weight parts of the above-mentioned unmodified polyester (a) were dissolved and mixed in 2000 weight parts of a 1:1 mixed solvent of ethyl acetate and MEK to obtain a solution of a toner binder (B). Part of this was dried under reduced pressure to isolate the toner binder (B), which had a peak molecular weight of 5000, a Tg of 62° C., and an acid value of 10.

Synthesis of Toner

Other than changing the dissolution temperature and dispersion temperature to 50° C., matrix toner particles were obtained in the same manner as toner A. 100 weight parts of these matrix toner particles were mixed with 1.0 weight part of a charge control agent composed of a zinc salt of a salicylic acid derivative, and the charge control agent was affixed to the particle surfaces by stirring in a heated atmosphere. 100 weight parts these matrix toner particles were mixed with 1.0 weight part hydrophobic silica and 0.5 weight part hydrophobic titanium oxide in a Henschel mixer to obtain a toner B. The shape factor SF-1 of this toner B was 130, its average circularity was 0.92, its degree of dispersion was 1.37, and its cohesion was 24%.

Next, toner C was manufactured as follows.

Synthesis of Toner Binder 30 weight parts of the above-mentioned urea-modified polyester (1) and 970 weight parts of the above-mentioned unmodified polyester (a) were dissolved and mixed in 2000 weight parts of a 1:1 mixed solvent of ethyl acetate and MEK. Part of the solution of the toner binder (C) thus obtained was dried under reduced pressure to isolate the toner binder (C), which had a peak molecular weight of 5000, a Tg of 62° C., and an acid value of 10.

Synthesis of Toner

Other than using the toner binder (C) and using 8 weight parts of carbon black as a colorant, toner C was obtained in the same manner as toner B. The shape factor SF-1 of this toner C was 125, its average circularity was 0.96, its degree of dispersion was 1.35, and its cohesion was 22%.

Next, toner D was manufactured as follows.

Synthesis of Toner Binder 500 weight parts of the above-mentioned urea-modified polyester (1) and 500 weight parts of the above-mentioned unmodified polyester (a) were dissolved and mixed in 2000 weight parts of a 1:1 mixed solvent of ethyl acetate and MEK. Part of the solution of the toner binder (D) thus obtained was dried under reduced pressure to isolate the toner binder (D), which had a peak molecular weight of 5000, a Tg of 62° C., and an acid value of 10.

Synthesis of Toner

Other than using the toner binder (D) and using 8 weight parts of carbon black as a colorant, toner D was obtained in the same manner as toner A. The shape factor SF-1 of this toner D was 120, its average circularity was 0.97, its degree of dispersion was 1.21, and its cohesion was 22%.

Next, toner E was manufactured as follows.

Synthesis of Toner Binder 750 weight parts of the above-mentioned urea-modified polyester (1) and 250 weight parts of the above-mentioned unmodified polyester (a) were dissolved and mixed in 2000 weight parts of a 1:1 mixed solvent of ethyl acetate and MEK. Part of the solution of the toner binder (E) thus obtained was dried under reduced pressure to isolate the toner binder (E), which had a peak molecular weight of 5000, a Tg of 62° C., and an acid value of 10.

Synthesis of Toner

Other than using the toner binder (E), toner E was obtained in the same manner as toner A. The shape factor SF-1 of this toner E was 115, its average circularity was 0.97, its degree of dispersion was 1.20, and its cohesion was 18%.

Next, toner F was manufactured as follows.

Synthesis of Toner 100 weight parts of the matrix toner particles of the above-mentioned toner binder (E) were mixed with 1.5 weight parts hydrophobic silica in a Henschel mixer to obtain toner F. The shape factor SF-1 of this toner F was 115, its average circularity was 0.97, its degree of dispersion was 1.20, and its cohesion was 7%.

A magnetic carrier was obtained by coating the surface of spherical ferrite having a weight average particle size of 50 μm with a silicone resin and then heat-drying this coating. The above-mentioned six types of toner were then each mixed with this magnetic carrier to obtain six types of two-component developing agent. The mix ratio of the toner and the magnetic carrier was adjusted to between 3.0 and 5.0 wt %.

A test printer with the same structure as that shown in FIG. 10 was manufactured by modifying an electrophotographic printer (Imagio NE0750) made by Ricoh. Using each of the above-mentioned six types of two-component developing agent, a grayscale image (see FIG. 1) was developed with this test printer. The printing operation of the printer was halted before the image was electrostatically transferred onto the transfer paper P, and the estimated average halftone granularity on the photoreceptor 1 was found by the same method as described above.

Next, the grayscale image was developed in the same manner using each of the above-mentioned six types of two-component developing agent, after which the image was electrostatically transferred onto the transfer paper P. However, the printing operation of the test machine was halted before the transfer paper P moved into the fixing apparatus 14, and transfer paper P on which an unfixed grayscale image was supported (hereinafter referred to as "unfixed transfer paper") was obtained. This same experiment was conducted under four different transfer nip pressure conditions and four different transfer current conditions, so that a total of 96 sheets of unfixed transfer paper were obtained (6 types of toner×4 different transfer nip pressure conditions×4 different transfer current conditions). The four different transfer nip pressure conditions comprised 0.04, 0.20, 1.00, and 2.00 N/mm$^2$. The four different transfer current conditions comprised 10, 20, 200, and 400 nA/mm$^2$.

The average halftone granularity of the grayscale image was measured for each of the 96 sheets of unfixed transfer paper obtained above. Since the grayscale images were unfixed here, there was the danger that the images would be smudged during reading by the scanner, and therefore films with a thickness of 0.1 mm and with measurement holes in them were first readied, these films were applied to the image-supporting side of the unfixed transfer paper, and only then was the film-bonded side put in contact with the bed of the scanner (Nexscan 4100 made by Heidelberg). The film thus functioned as a spacer so that the region of the grayscale image to be measured did not touch the scanner bed, and [the image] was read at a resolution of 1200 dpi. The average halftone granularity of the grayscale image after developing but before fixing was found on the basis of the electronic data thus obtained.

The above-mentioned 96 sheets of unfixed transfer paper were then passed through the fixing apparatus 14 to obtain printed paper. Similar printed paper was also obtained under varied fixing conditions. This output was put together with the previous printed paper and tested under three different fixing conditions to obtain a total of 288 sheets of printed paper. The fixing conditions were varied three ways, such that one of the ①, ②, and ③ listed in the first embodiment above was used as the fixing roller 14*a* that was in close contact with the toner image, that is, the one that functioned as the heating member. The average halftone granularity of the grayscale image after fixing was measured on the basis of the printed paper thus obtained.

FIG. 30 is a table of the properties of toner A and of the estimated average halftone granularity after developing (before transfer) of the grayscale images obtained using this toner A. FIGS. 31 to 35 show the relation between the properties of toners B, C, D, E, and F and the estimated average halftone granularity after developing (before transfer) of the grayscale images. These tables also show the transfer ratio, the average halftone granularity after developing but before fixing, and the average halftone granularity after fixing.

A comparison of the shape factor SF-1, average circularity, and degree of dispersion with the estimated average halftone granularity of a grayscale image after developing but before transfer on the photoreceptor 1 between FIGS. 30 to 35 reveals the following. The lower is the shape factor SF-1 of the toner, the less roughness the toner image will have. Also, the higher is the average circularity, the less roughness the toner image will have. Also, the smaller is the degree of dispersion, less roughness the toner image will have. Thus, to minimize roughness in a toner image after developing but before transfer, the shape factor SF-1 of the toner should be as low as possible, its average circularity as high as possible, and its degree of dispersion as small as possible.

However, as shown in FIG. 30, even with toner A, for which the conditions were the worst, the toner image (grayscale image) after developing but before transfer has an estimated average halftone granularity of 0.18, which is well below 0.25.

In view of this, as long as the toner used in this printer is one that meets or exceeds the conditions of toner A, the various image conditions are set so that the estimated average halftone granularity of the toner image after developing but before transfer on the photoreceptor 1 will be 0.18 or less. The "meets or exceeds the conditions" above specifically means that the shape factor SF-1 is 140 or less, the average circularity is at least 0.92, and the degree of dispersion is 1.39 or less. Also, the user is advised to use a toner that meets these conditions. Thus, as long as the recommended toner is used, an image with density gradation can be reliably formed at a high level of quality, that at least gives no impression of low quality in the state after developing but before transfer.

The specification of the toner may be accomplished, for example, by packaging and shipping a toner that meets the above conditions along with the printer (image forming apparatus). This may also be accomplished, for example, by marking the printer unit, its instruction manual, etc., with the stock number, merchandise name, and so forth of such toner. Alternatively, it can be accomplished, for example, by notifying the user of the above-mentioned stock number, merchandise name, and so forth in writing, by electronic data, or the like. Another way it can be accomplished is to ship the printer with such a toner already installed in the toner housing means inside the printer.

Next, a first modification of the printer pertaining to this embodiment will be described.

It can be seen from a comparison of the increase in granularity due to electrostatic transfer in FIGS. 30 to 35 that, if we look only at electrostatic transfer, the shape factor SF-1 of the toner has little effect on the average halftone granularity of the toner image after transfer but before fixing. Also, it can be seen from a comparison of average circularity or degree of dispersion with the increase in granularity due to electrostatic transfer that, if we look only at electrostatic transfer, the average circularity or degree of dispersion of the toner also has little effect on the average halftone granularity. Since the shape factor SF-1, average circularity, and degree of dispersion each has a major effect in the developing step prior to electrostatic transfer, the average halftone granularity of the image after transfer and before transfer must vary greatly. Thus, if we look only at electrostatic transfer, the shape factor SF-1, average circularity, and degree of dispersion of the toner are not all that critical.

In contrast, it can be seen from a comparison of transfer nip pressure or transfer current with the increase in granularity due to electrostatic transfer in FIGS. 31 to 35 that the former has a major effect on the latter. Specifically, if either the transfer nip pressure or the transfer current is too low or too high, the average halftone granularity of the grayscale image after transfer will be much worse.

The reason the average halftone granularity of the grayscale image after transfer will be much worse if the transfer nip pressure is too low, the reason the average halftone granularity of the grayscale image after transfer is much worse if the transfer nip pressure is too high, the reason the average halftone granularity of the grayscale image after transfer is much worse if the transfer current is too-low, the reason the average halftone granularity of the grayscale image after transfer is much worse if the transfer current is too high, and so forth are the same as discussed above in the first embodiment.

Although not shown in FIG. 5, with toner A the average halftone granularity of the grayscale image after transfer exceeded 0.25 regardless of the transfer nip pressure or transfer current. The reason is that the estimated average halftone granularity of the toner image after developing but before transfer was so poor that the average halftone granularity after transfer ended up exceeding 0.25.

Thus, the following is necessary in order to obtain image quality in which the average halftone granularity is 0.25 or less (no roughness) with a toner image after developing but before fixing. Using a toner with suitable properties, developing must be performed so that the estimated average halftone granularity after developing will be as good as possible, and electrostatic transfer performed at a suitable transfer nip pressure and transfer current. An examination of this on the basis of the data in the tables indicates that the conditions listed below must be met.

- The toner must have a shape factor SF-1 of 130 or less, an average circularity of at least 0.92, and a degree of dispersion of 1.37 or less.
- The electrostatic transfer must be performed at a transfer current of 20 to 200 nA/mm$^2$.
- The transfer nip must be formed by pressing the transfer roller 4 against the photoreceptor 1 at a pressure (transfer nip pressure) of 0.20 to 1.00 N/mm$^2$.

In view of the above, for the printer pertaining to this embodiment, the user is advised to use a toner with a shape factor SF-1 of 130 or less, an average circularity of at least 0.92, and a degree of dispersion of 1.37 or less. Also, the transfer current is set at 20 to 200 nA/mm$^2$, and the transfer nip pressure is set at 0.20 to 1.00 N/mm$^2$. Thus, as long as the recommended toner is used, an image with area ratio gradation can be reliably formed at a high level of quality, that at least gives no impression of low quality after transfer but before fixing. The methods for specifying this toner are the same as for the printer in this embodiment.

FIGS. 22, 23, and 24 respectively show grayscale images in which the average halftone granularity is 0.20, 0.49, and 0.90 after transfer but before fixing, for toners whose weight average particle size is 4.2, 6.8, and 9.0 μm, just as in the first embodiment above.

A second modification of the printer pertaining to this embodiment will now be described.

It can be seen that, basically, to obtain a fixed, final grayscale image whose average halftone granularity is 0.25 or less, one of the conditions 1 to 3 listed below must be met.

Condition 1

- The toner has a shape factor SF-1 of 125 or less, an average circularity of at least 0.96, and a degree of dispersion of 1.35 or less.
- The transfer current is set between 20 and 200 nA/mm$^2$.
- The transfer nip pressure is set between 0.20 and 1.00 N/mm$^2$.
- The fixing roller 14*a* that is in contact with the toner image is ① above.

Condition 2

- The toner has a shape factor SF-1 of 120 or less, an average circularity of at least 0.97, and a degree of dispersion of 1.21 or less.
- The transfer current is set between 20 and 200 nA/mm$^2$.
- The transfer nip pressure is set between 0.20 and 1.00 N/mm$^2$.
- The fixing roller 14*a* that is in contact with the toner image is ① above.

Condition 3

The toner has a shape factor SF-1 of 115 or less, an average circularity of at least 0.97, and a degree of dispersion of 1.20 or less.

The transfer current is set between 20 and 200 nA/mm$^2$.

The transfer nip pressure is set between 0.20 and 1.00 N/mm$^2$.

The fixing roller 14*a* that is in contact with the toner image is ① or ② above.

In view of the above, the user is advised to use a toner that meets one of the above conditions 1 to 3. Also, the transfer current is set at 20 to 200 nA/mm$^2$, and the transfer nip pressure is set at 0.20 to 1.00 N/mm$^2$. Further, when the user is advised to use a toner that meets condition 1 or 2, the above-mentioned ① is provided as the fixing roller 14*a* that is in contact with the toner image. On the other hand, when the user is advised to use a toner that meets condition 3, the above-mentioned ① or ② is provided as this roller. Thus, as long as the recommended toner is used, an image with density gradation can be reliably formed at a high level of quality, that at least gives no impression of low quality after fixing.

FIGS. 26, 27, and 28 respectively show the image portion of grayscale images in which the increase in granularity during fixing is 0.04, 0.10, and 0.15, just as in the first embodiment above.

A third modification of the printer pertaining to this embodiment will now be described.

As described through reference to FIG. 30 in this embodiment, a toner image (grayscale image) after developing but before transfer having an estimated average halftone granularity of 0.18, which is well below 0.25, can be obtained even with toner A, for which the conditions were the worst.

However, although not shown in FIG. 30, when toner A was used it was impossible to obtain a final, fixed grayscale image with an average halftone granularity of 0.25 or less. Also, as shown in FIG. 30, when toner B was used an image with an estimated average halftone granularity of 0.17 or less after developing but before transfer could be obtained. However, a final, fixed image with an average halftone granularity of 0.25 or less still could not be obtained.

It can be seen that to obtain a final, fixed image with an average halftone granularity of 0.25 or less, as shown in FIGS. 32 to 35, the image after developing but before transfer has to have an estimated average halftone granularity of 0.15 or less.

With the above printer pertaining to this embodiment, the toner used to form the toner image was manufactured by polymerization, the shape factor SF-1 was set at 140 or less, the average circularity at 0.92 or higher, and the degree of dispersion at 1.39 or less, so as long as this toner is used, an image with density gradation can be reliably formed at a high level of quality, that at least gives no impression of low quality in the state after developing but before transfer.

Also, with the above printer pertaining to this embodiment, the average halftone granularity of the toner image after electrostatic transfer but before fixing is 0.25 or less, so an image with density gradation can be reliably formed at a high level of quality, that at least gives no impression of low quality in the state after transfer but before fixing.

Further, the toner used to form the toner image is specified to have an shape factor SF-1 of 130 or less, an average circularity of at least 0.92, and a degree of dispersion of 1.37 or less, the transfer current is set to between 20 and 200 nA/mm$^2$, and the transfer nip pressure is set to between 0.20 and 1.00 N/mm$^2$. Thus, as long as the specified toner is used, an image can be reliably formed at a high level of quality, that at least gives no impression of low quality in the state after transfer but before fixing.

Also, with the printer pertaining to this embodiment, the average halftone granularity of the toner image after fixing is 0.25 or less, so an image with density gradation can be reliably formed at a high level of quality, that gives no impression of low quality after fixing.

Further, [the toner] meets one of the above-mentioned conditions 1 to 3. Thus, as long as a toner that meets one of these conditions is used, an image can be reliably formed at a high level of quality, that gives no impression of low quality after fixing.

Further, with the printer pertaining to this embodiment, the estimated average halftone granularity of the toner image after developing but before transfer is 0.15 or less, and the average halftone granularity of the toner image after fixing is 0.25 or less, so an image with density gradation after fixing can be reliably formed at a high level of quality, that gives no impression of low quality.

Further, the toner meets one of the above-mentioned conditions 1 to 3. Thus, as long as a toner that meets one of these conditions is used, an image can be reliably formed at a high level of quality, that gives no impression of low quality.

As described above, with the present invention, an image with density gradation can be reliably formed at a high level of quality, that at least gives no impression of low quality in the state after developing but before transfer.

Also, with the present invention, an image with density gradation after fixing can be reliably formed at a high level of quality, that at least gives no impression of low quality.

Various modifications will become possible for those skilled in the art after receiving the teachings of the present disclosure without departing from the scope thereof.

What is claimed is:

1. An image forming method for forming a toner image on a recording medium, comprising the steps of:

supporting a latent image on a latent image support; and using toner to develop the latent image on said latent image support, the estimated average halftone granularity of the toner image after developing being 0.25 or less.

2. The image forming method as claimed in claim 1, further the steps of electrostatically transferring the toner image on said latent image support onto a recording medium and bringing a heating member into close contact with the toner image electrostactically transferred onto said recording medium and thereby fixing said toner image to said recording medium.

3. The image forming method as claimed in claim 2, wherein said estimated average halftone granularity of the toner image before electrostatic transfer is 0.25 or less.

4. An image forming apparatus, comprising:

a latent image support for supporting a latent image; and developing means for using toner to develop the latent image on said latent image support, the estimated average halftone granularity of the toner image after developing being 0.25 or less.

5. The image forming apparatus as claimed in claim 4, further comprising transfer means for electrostatically transferring the toner image on said latent image support onto a recording medium and fixing means for bringing a heating member into close contact with the toner image electrostactically transferred onto said recording medium and thereby fixing said toner image to said recording medium.

6. The image forming apparatus as claimed in claim 5, wherein said estimated average halftone granularity of the toner image before electrostatic transfer is 0.25 or less.

7. The image forming apparatus as claimed in claim 6, wherein a toner having a weight average particle size of 4.2 to 6.8 μm is specified as the toner used to form the toner image.

8. The image forming apparatus as claimed in claim 6, further comprising toner housing means for housing the toner used to develop the latent image one the latent image support, said toner housing means housing a toner with a weight average particle size of 4.2 to 6.8 μm.

* * * * *